US008245444B2

(12) United States Patent
Konstantin et al.

(10) Patent No.: US 8,245,444 B2
(45) Date of Patent: Aug. 21, 2012

(54) LIGHT-CONTROL ASSEMBLY

(76) Inventors: Moshe Konstantin, Highland Park, IL (US); Eitan Konstantino, Orinda, CA (US)

( * ) Notice: Subject to any disclaimer, the term of this patent is extended or adjusted under 35 U.S.C. 154(b) by 0 days.

(21) Appl. No.: 12/903,904

(22) Filed: Oct. 13, 2010

(65) Prior Publication Data

US 2011/0067824 A1 Mar. 24, 2011

(51) Int. Cl.
*E06B 7/096* (2006.01)

(52) U.S. Cl. ..... 49/82.1; 49/92.1; 160/176.1 V

(58) Field of Classification Search ..... 49/74.1–92.1; 160/172 V, 176.1 V
See application file for complete search history.

(56) References Cited

U.S. PATENT DOCUMENTS

| | | | | | |
|---|---|---|---|---|---|
| 14,798 | A | | 5/1856 | Bruff | |
| 153,405 | A | | 7/1874 | Van Horn et al. | |
| 314,393 | A | | 3/1885 | Paradise | |
| 1,914,571 | A | * | 6/1933 | Jones | 49/77.1 |
| 2,281,022 | A | | 4/1942 | Cavanaugh | |
| 2,545,906 | A | | 3/1951 | Watkins | |
| 2,565,979 | A | | 8/1951 | Michaelsen | |
| 2,572,957 | A | | 10/1951 | Shaw | |
| 2,700,803 | A | * | 2/1955 | Graham | 49/86.1 |
| 3,012,294 | A | * | 12/1961 | Waldor | 52/207 |
| 3,120,035 | A | * | 2/1964 | Morris | 49/77.1 |
| 3,375,608 | A | * | 4/1968 | Thompson | 49/403 |
| 3,645,317 | A | | 2/1972 | Malone | |
| 4,294,283 | A | * | 10/1981 | Scharres | 137/599.02 |
| 4,427,048 | A | | 1/1984 | Osaka et al. | |
| 4,435,919 | A | * | 3/1984 | Poisson | 49/63 |
| 4,469,132 | A | * | 9/1984 | Redington | 137/601.06 |
| 5,016,390 | A | | 5/1991 | Johnson | |
| 5,052,150 | A | | 10/1991 | Chen | |
| 5,204,777 | A | | 4/1993 | Curshod | |
| 5,221,363 | A | | 6/1993 | Gillard | |
| 5,469,658 | A | | 11/1995 | Digianni et al. | |
| 5,564,229 | A | | 10/1996 | Noska | |
| 5,600,920 | A | | 2/1997 | Roy | |
| 5,608,990 | A | | 3/1997 | Kyle | |
| 5,794,380 | A | * | 8/1998 | Guardia | 49/74.1 |
| 5,918,417 | A | | 7/1999 | Kinder | |
| 6,085,825 | A | | 7/2000 | Swink et al. | |
| 6,134,842 | A | | 10/2000 | Cheng et al. | |
| 6,499,255 | B1 | | 12/2002 | Givoni | |
| 6,807,772 | B2 | | 10/2004 | Halter | |
| 6,978,578 | B2 | * | 12/2005 | Givoni | 52/173.3 |
| 7,281,353 | B2 | * | 10/2007 | Konstantin | 49/82.1 |
| 2002/0129553 | A1 | | 9/2002 | Metzen et al. | |
| 2006/0238994 | A1 | | 10/2006 | Chery et al. | |
| 2006/0288645 | A1 | * | 12/2006 | Konstantino et al. | 49/92.1 |
| 2008/0035275 | A1 | * | 2/2008 | Konstantin | 160/5 |

FOREIGN PATENT DOCUMENTS

| | | | |
|---|---|---|---|
| WO | 2005/003498 | A2 | 1/2005 |

* cited by examiner

*Primary Examiner* — David Purol
(74) *Attorney, Agent, or Firm* — Drinker Biddle & Reath LLP

(57) ABSTRACT

A light-control assembly including a modular beam with a plurality of adjacent circular bores separated by web portions, at least two bearing members each having an annular ring dimensioned to fit within the bores with non-interfering flanges extending radially outwardly from the rings mounted in the bores, and a series of light-controlling members mounted in the bearing members.

20 Claims, 18 Drawing Sheets

LIGHT-CONTROL ASSEMBLY

FIELD OF THE INVENTION

This invention pertains to a readily constructed light-control assembly designed for reliable light-blocking that is particularly effective in dynamic control of daylighting and shading. In the light-control assembly opaque or translucent slats or other light-blocking members are rotated up to 360° by applying rotary force at a single end of each of the light-blocking members, and less preferably at both ends thereof. The assembly achieves unusually effective light-blocking through the use of a beam having circular bores with bearing members associated with the bores that have offset flanges or other engagement means to ensure accurate positioning and reliable operation of the bearing members over a range of 360° rotation of light-blocking members mounted in the bearing members. The bearing members are coupled to the beam with offset positioning of the flanges or other engagement means making it possible to closely fit abutting edges of the light-blocking members by overlapping the web portions between adjacent bores in the beam to achieve enhanced, uniform light-blocking.

BACKGROUND OF THE INVENTION

The U.S. Department of Energy as well as sustainable construction organizations and the like are pressing for the installation of dynamic daylighting and shading systems to improve energy efficiency in buildings. Innovations like that of the present invention are sorely needed to meet this need.

Various types of transparent and translucent glazing systems are available for the construction of horizontal, vertical and sloped glazing in skylights, roofs, walls, and other architectural structures designed to pass light for daylighting interiors or other purposes. When using such glazing systems, it is therefore desirable, in accord with sustainable construction criteria, to optimize the system's shading coefficient to reduce solar heat gain on hot summer days and during peak sunlight hours year round, while providing maximum light and solar heating on cold winter days and when it is otherwise needed or desired. It is also often desirable to control glare and direct sunlight in order to ensure the comfort of those who occupy the space exposed to the glazing system. If architects and space planners can be freed from the constraints of current light transmission control in horizontal, vertical and sloped glazing in skylights, roofs, walls, and other architectural structures, they will be able to more effectively address these shading requirements and meet sustainable construction criteria. Furthermore, these considerations apply as well to shading of open unglazed areas.

Indeed, if the level of light entering overhead large glazed as well as unglazed areas can be simply, efficiently, effectively and uniformly controlled without significant light leakage between, e.g., multiple adjacent light-controlling members, it will further enable architects and space planners maximize energy efficiency with aesthetic and sustainable designs. However, this requires light-controlling assemblies and sun control systems that can be dynamically controlled. For example, sun tracking control shading systems that can dynamically rotate light-locking members up to 360° to shade small or large glazed and open, unglazed areas to provide the desired uniform light level inside the space thereunder would be particularly desirable.

The known approaches to controlling the amount of light admitted through glazing systems—particularly on a large scale and in overhead, horizontal and sloped glazing applications—are limited and are generally unreliable, noisy and often difficult and expensive to construct, assemble on-site, maintain and service. Also, existing approaches suffer from non-uniform and excessive light leakage between adjacent light-controlling members which appears as an aesthetically undesirable series of often irregular bright lines. Additionally, although it is often desirable to retrofit light-controlling systems to already constructed glazing systems, this is not easily accomplished with any of the current light-controlling systems. There is therefore a substantial need for an economic and readily constructed and retrofitted light-controlling system that may be used for shading glazed areas of all sizes, including very large glazed areas. There is also substantial need for such light-controlling systems that can be easily assembled, maintained and serviced, in which the light is uniformly distributed across the glazed area, and in which light leakage is de minimis or eliminated and, where present, is kept to narrow and regular lines.

Prior approaches to controlling the level of light passing into architectural structures have included louver blind assemblies using pivoting flexible light-controlling members operable behind a window or sandwiched inside a chamber formed by a double-glazed window unit. Such louver blinds require substantial support of the flexible members which, additionally, must be controlled from both their distal and their proximal ends. Furthermore, louver blinds are difficult and expensive to assemble, apply, operate, maintain and replace, and cannot be readily adapted for use in non-vertical applications or in applications in which it is either desirable or necessary to control the flexible members from only one end. Louver blinds are particularly problematic when it comes to applications in which the installation requiring light-control or shading is very long, e.g., 10 ft., 20 ft., 60 ft. or more. In addition, dynamic control of louver blinds in large overhead shading applications is complicated, expensive, difficult to install and maintain, and often simply impractical. Furthermore, rotating louver blinds requires that the rotary force be applied to the top edge of the blinds. This is because louver blinds are flexible and rely on the force of gravity to hang vertically in the proper desired position and therefore cannot be rotated from their base. Thus, louver blinds cannot be used in generally horizontal overhead glazing application or in sloped applications, where rotation must be controlled from the base or proximal end and the force of gravity on non-vertical louver blinds would create untold complications and very non-uniform shading.

Other approaches to controlling the level of light passing through architectural structures have used motorized shades or drapery. These approaches are also problematic, particularly in the applications noted above where the glazing is large and would require lengthy shades or blinds, e.g., on the order of 10 ft., 20 ft., 60 ft. or more, since such large shades would be heavy, difficult to manipulate and maintain, and expensive. The mechanics of controlling and manipulating motorized shades or drapery of any size is quite complicated and therefore motorized shades and drapery are expensive and difficult to maintain. Also, it is not possible to achieve uniform light distribution across a wide glazed space with motorized shades or drapery.

U.S. Pat. Nos. 7,281,353; 6,499,255; and 6,978,578 provide other more recent approaches to addressing the challenge of providing dynamic daylighting and shading systems on a large scale and in overhead, horizontal and sloped glazing applications. These patents utilize a plurality of rotatably-mounted light-blocking tubular members having at least one portion that is substantially opaque and means for rotating the light-blocking members to block out varying amounts of radiation by varying the area of the opaque portions presented to the incoming light. In the systems described in the above three patents, the light-blocking members are combined in a series of adjacent segregated elongated tubular cells or mounted for rotation in individual or paired cross-members positioned between light transmitting panels. As an alternative to tubular members, a generally rigid opaque member may be used if fitted with rings spaced along this member. Indeed, even the tubular members may be fitted with such rings in order to facilitate tubular member rotation and to improve performance. Attachment of the rings requires notching of the generally rigid opaque member and is difficult and time consuming for both generally flat and tubular members. Also, the rings interfere with light-blocking and must be wide enough to accommodate longitudinal movement due to thermal expansion and contraction. Thus, determining the width and location of the rings and receiving notches is complex and, indeed, may require architectural approval before being implemented in custom applications, often making the use of such rings inconvenient and expensive.

In the system of the '578 patent, the centers of rotation of the light-blocking members do not remain in place as the light-blocking members are rotated resulting in increased torque and load on the motor and varying horizontal positioning of the light-controlling members. Since the light-controlling members often do not run true because they are inadequately restrained and therefore bend and snake about as they rotate, uneven and continuously varying spacing between adjacent members is produced with uneven light distribution and an unacceptable appearance of disarray of the radiation blocking members. When these light-controlling members are used in vertically oriented applications, the light-blocking members disengage from lower-cross-members and run far more untrue with even greater increases in the torque/motor load and irregular lateral movement. When they are used in applications calling for an inclined orientation, the light-blocking members tend to disengage from the lower cross members and rotate in an uncontrolled manner, rubbing against one another, resulting in increased friction and torque and producing problematic noise. Finally, in tests simulating the application of snow and wind loads, excessive friction is produced between the light-blocking members and the cross-members which could cause early failure.

The paired upper and lower cross members of the '353 patent solve the above problems. However, even this dual cross member design has drawbacks where rings and notching are used. Also, when this system is in the fully closed position, there is still more light leakage than is often desired.

While the designs provided by the above three patents nevertheless represent important advances in the art, they have another serious drawback. For these designs, the light-blocking components of adjacent tubular members cannot come sufficiently close to each other when the systems are in their fully closed configuration due to intervening structural features including the material between adjacent tubular cells in the '255 patent and the tube and ring walls in the designs of the '578 and '353 patents. Therefore total blackout or near total blackout light blocking cannot be achieved.

SUMMARY

It is therefore one objective of this invention to provide a light-control assembly in which the transmission of light can be adjusted from almost full transparency or passage of light to total black-out or near total black-out.

It is another objective of the present invention to provide a light-control assembly that is reliable, quiet in operation, and readily constructed, maintained and serviced.

It is yet another objective of the present invention to provide a light-control assembly that may be readily assembled on-site and that can be used in both new construction and retrofit applications.

It is still a further objective of the present invention to provide a light-control assembly that accommodates thermal expansion and contraction of the components of the assembly, including the light-controlling members, when the assembly is subjected to wide-ranging temperature changes at the site of installation so that, e.g., slats in the assembly can move longitudinally within bearing members free from limitations imposed by rings and notches as the slats lengthen or shorten due to temperature swings.

Still another objective of the present invention is to provide a light-control assembly that may be readily used with horizontal, vertical and sloped glazing in skylights, roofs, walls and other glazed and open unglazed architectural structures designed to pass light for daylighting interiors or other purposes.

Another objective of the present invention is to provide a light-control assembly that can be readily serviced on-site.

Yet another objective of the invention is to provide light-control assemblies that can be spaced along any desired length of adjoining long light-blocking members to accommodate rotation of the light-blocking members up to 360° by applying a rotary force about their longitudinal axes at only one end of the light-blocking members.

A still further objective of the invention is to provide a light-control assembly that can simply and efficiently be used with photovoltaic members.

Another objective of the invention is to provide light-control assemblies that can be made of modular components so larger assemblies can be economically and readily constructed and used in dynamic control of daylighting and shading in applications of varying widths.

A still further objective of the present invention is to provide a light-control assembly that can accommodate radius bends in light-blocking members and that will continue to operate reliably in such installations.

It is still another objective of the present invention to provide a light-control assembly with light-controlling members that are free of notching and/or rings or other structurally weakening material removal and can be easily and simply slid into position.

It is a further objective of this invention to provide efficient, economic means for supporting and maintaining light-controlling members in panel units having spaced flat panels or sheets in ways not heretofore thought possible.

These and other objectives of the present invention will become apparent to those skilled in the art upon consideration of the accompanying specification, claims and drawings.

BRIEF DESCRIPTION OF THE DRAWINGS

The invention, together with its objects and advantages, may be best understood by reference to the following description, taken in conjunction with the following drawings, in which like reference numerals identify like elements in the several figures, and in which:

FIG. 3B includes an end elevation view of a tubular light-controlling member, a front elevation view of yet another bearing member design and an end elevation view of the tubular light-controlling member mounted in this bearing member;

FIG. 5B includes partial perspective views of the back side of two portions of the retainers of FIGS. 1 and 4A showing corresponding locking pins and locking cavities;

DETAILED DESCRIPTION OF THE INVENTION

The embodiments of the invention described in detail below are not intended to be exhaustive or to limit the invention claimed to the precise structures and operations disclosed. Rather, these embodiments have been chosen and described to highlight selected principles of the invention and its application, operation and use in order to best enable those skilled in the art and others to follow its teachings.

Figure 1:
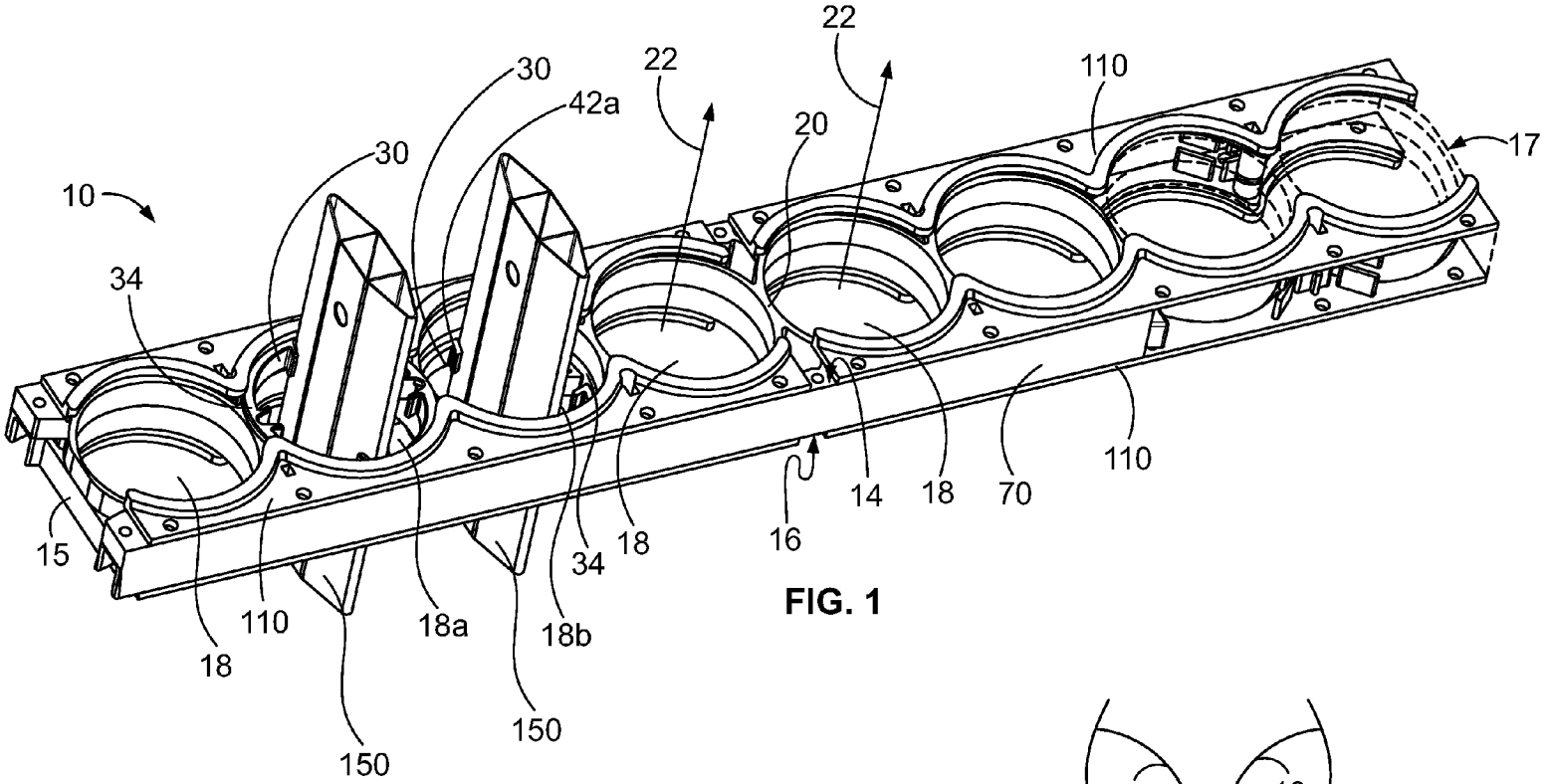
FIG. 1 is a perspective view of an exemplary light-control assembly in accordance with the invention including a single beam and two pairs of retainers.

Turning now to FIG. 1, a light-control assembly 10 is illustrated. Assembly 10 includes first and second opposed faces 14 and 16 first and second ends 15 and 17, and a series of adjacent circular bores 18 extending between the opposed faces of the assembly and exemplary bearing members 30 shown mounted in two adjacent bores 18*a* and 18*b*. Bores 18 are formed in the beam 70 (FIG. 4A) of the assembly which will be described below. The longitudinal axes 22 of the bores preferably will be generally parallel to each other although they need not be generally parallel in all embodiments of the invention.

Figure 1A:
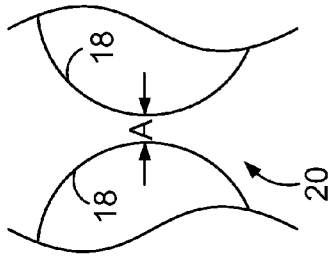
FIG. 1A is a partial view of a web portion between adjacent bores in the beam of the light-control assembly of FIG. 1.

Adjacent circular bores 18 are separated by a web portion 20 (FIGS. 1 and 1A) of beam 70 (FIG. 4A) defined by the lateral spacing of the bores. Web portion 20 will be shaped as indicated in FIG. 1A with its thinnest dimension "A" at the point where the diameters of the adjacent bores that define the web are co-linear.

It is preferred that web portion 20 be as thin as possible in order to optimize the light-blocking performance of the light-control assembly by minimizing the distance between the adjacent edges of the light-controlling members when they are in the closed position, as will be described in more detail below in connection with FIGS. 6C and 6F. Of course, web portion 20 must not be so thin as to adversely affect the structural integrity of the beam. Thus, the thickness of thinnest dimension "A" at the point where the diameters of the adjacent bores that define the web are co-linear will depend on the material out of which beam 70 is made as well as the thickness of the beam between its opposed forces and other structural features of the beam and other structural components of the light-control assembly. In one embodiment, where the beam is made out of polycarbonate, the bores are about 45 mm in diameter and the thickness between the opposed faces of the beam is about 16 mm, the web should be no thinner than about 1 mm.

Figure 2A:
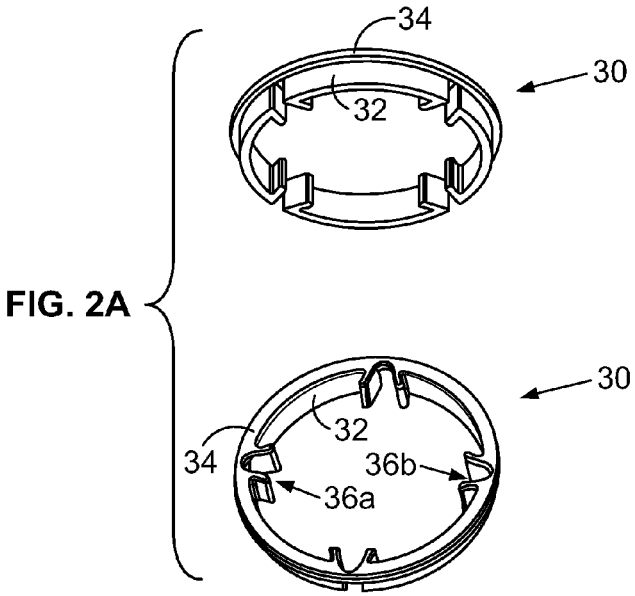
FIG. 2A includes top and bottom perspective views of an exemplary flanged bearing member that may be used in a light-control assembly in accordance with the invention.
Figure 2C:
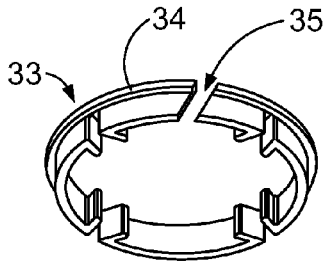
FIG. 2C is a view of a bearing member as in FIGS. 2A and 2B with the addition of a slot in the side of the bearing member.
Figure 2B:
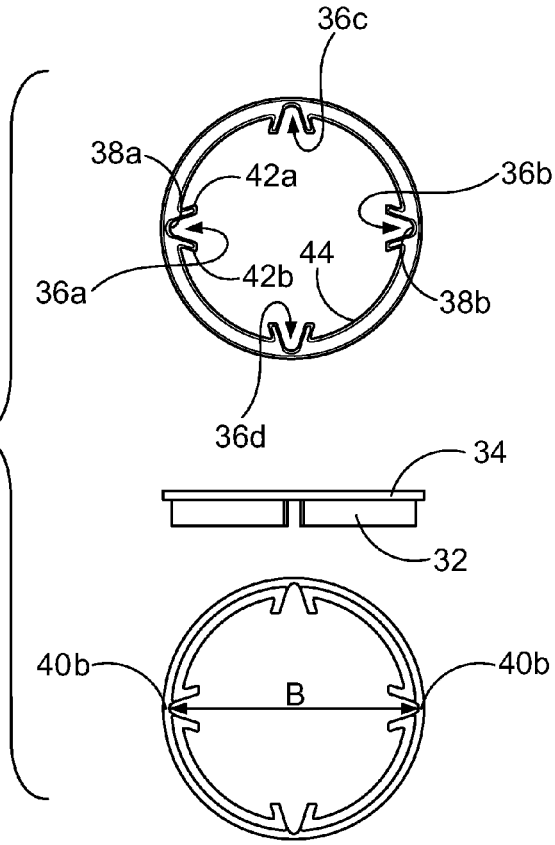
FIG. 2B includes top, elevation and bottom views of the bearing member of FIG. 2A.

Light-control assembly 10 includes exemplary bearing members 30 as shown in FIG. 1 and as illustrated in enlarged form in FIGS. 2A and 2B. In this embodiment, bearing members 30 each include an annular ring 32 dimensioned to fit rotatably within bores 18 and a retention flange 34 extending radially outwardly from the rings. The width of flange 34 should be less than or equal to the thickness of web portion 20 between the bores to preclude interference between the flange and light-blocking members mounted in bearings in the adjacent bores.

Bearing members 30 have at least two diametrically opposed notches 36*a* and 36*b*. Notches 36*a* and 36*b* have opposed notch bottoms 38*a* and 38*b* spaced a predetermined distance apart "B". In the embodiment of these figures, notches 36*a* and 36*b* extend through the rings and into the flanges leaving web portions of the flange 40*a* and 40*b* below the bottom of each of the notches. In this illustrated embodiment bearing members 30 also include an optional second pair of diametrically opposed notches 36*c* and 36*d* equally spaced from notches 36*a* and 36*b* to help maintain the circularity of the bearing members when they are made by a plastic injection molding process.

The bearing members in this embodiment also include pairs of guide and retention tabs 42*a* and 42*b* located on opposite edges of the notches. Tabs 42*a* and 42*b* project from the inner surface 44 of the ring to define a "V" shaped receiving cavity that opens towards the center of the bearing member.

Figure 11:
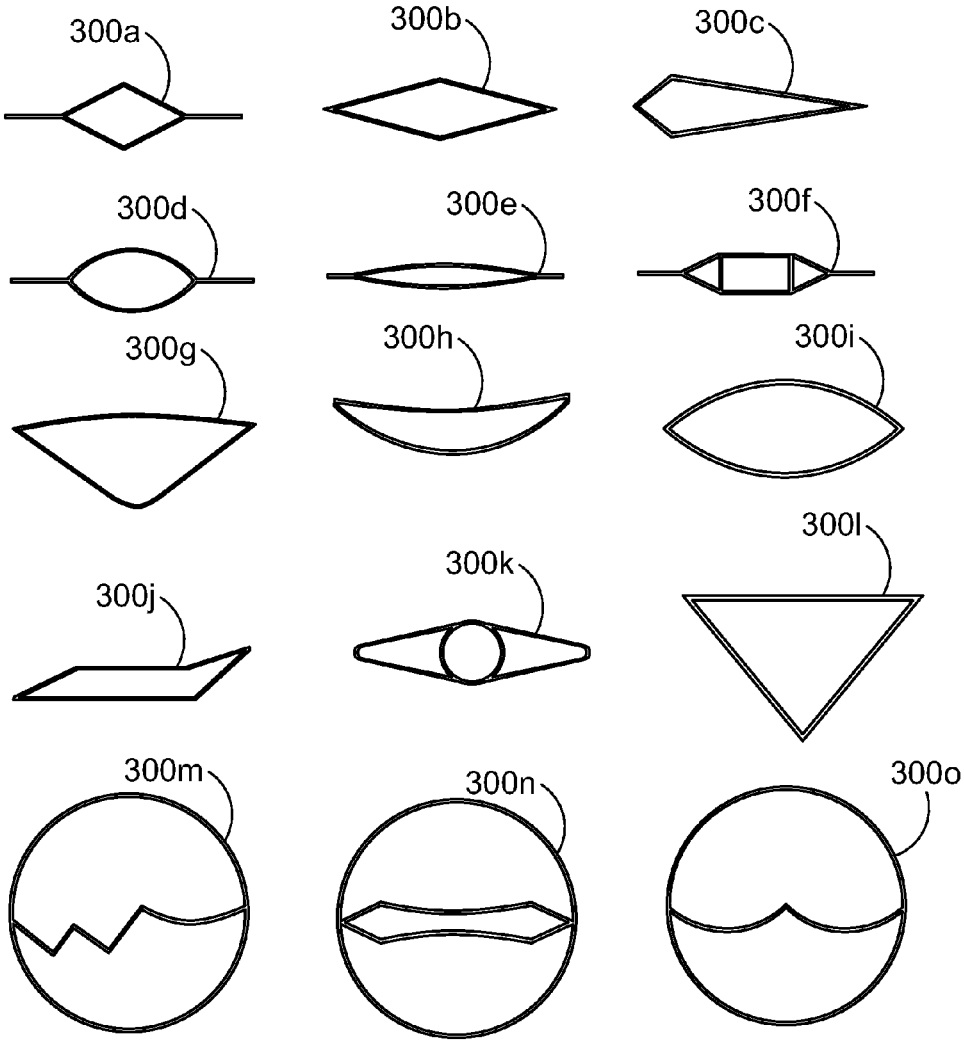
FIG. 11 depicts a series of alternative light-blocking member configurations.
Figure 12:
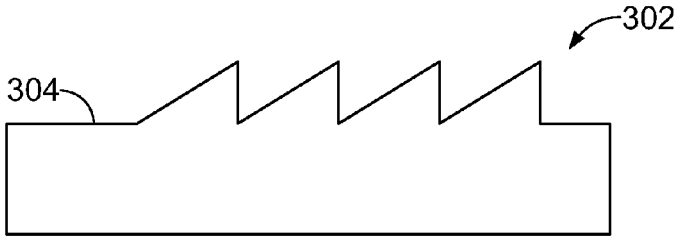
FIG. 12 depicts micro-prismatic toothing on the surface of a light-blocking member.
Figure 13:
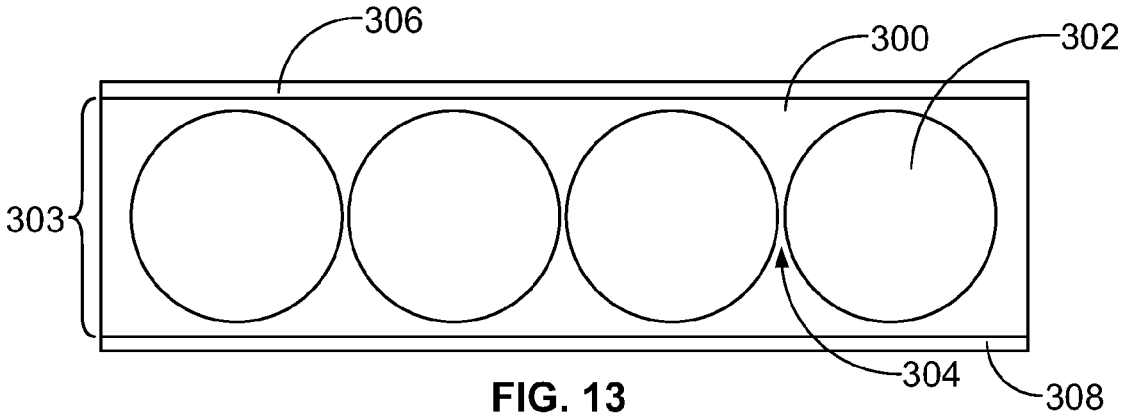
FIG. 13 is a front elevation view of an alternative embodiment of a beam in accordance with the present invention and FIG. 13A is side elevation view thereof.

Notches 36*a* and 36*b* (optionally including retention tabs 42*a* and 42*a*) are designed to receive light-blocking members in the form, for example, of slats 150, which are described below in connection with the description of FIGS. 6A-6E and which themselves act as opaque reflecting, spectral controlling or translucent barriers. Notches 36*a* and 36*b*, of course, can receive other types of light-blocking members that act as opaque, translucent, reflecting or spectral controlling barriers including without limitation flat light-blocking members, light-blocking members 300*a*-300*k* of FIG. 11, tubular designs light-blocking members 300*l*-300*o* of FIG. 11 and the tubular hemispherical light-controlling members fitted with opaque or translucent barriers, as described below. The shapes shown in FIG. 11 employ the principle of retro-reflection as disclosed in US 2006/028845A1, the pertinent disclosure of which is incorporated by reference. Finally, as illustrated in FIG. 12, micro-prismatic toothing 302 may be provided on the surface 304 of a light-blocking member to achieve retro-reflection either alone or on a geometric retro-reflective surface as in FIG. 11. Such micro-prismatic toothing will help avoid overheating and glare. Also, the micro-structured mirroring may be rolled onto an aluminum substrate, and then glossed, anodized and formed into a desired geometrical shape.

FIG. 2C illustrates an alternative bearing member structure 33 having a relief slot 35 that passes through the annular ring and retention flanges of the bearing member. This slot facilitates mounting of bearing members structured in this way since the bearing member can be pressed together to close the slot when the rings are inserted in the bores. After insertion, the bearing members will be released so that they can spring back to their original configuration ensuring rotatable mounting in the bores. (See also the discussion of FIG. 17 in which a differently configured bearing member is also preferably provided with a relief slot). Such slotted bearing members not only facilitate assembly into the bores but also are forgiving of tolerance variations and thermal expansion/contraction of other components in the light-control assembly.

Figure 2D:
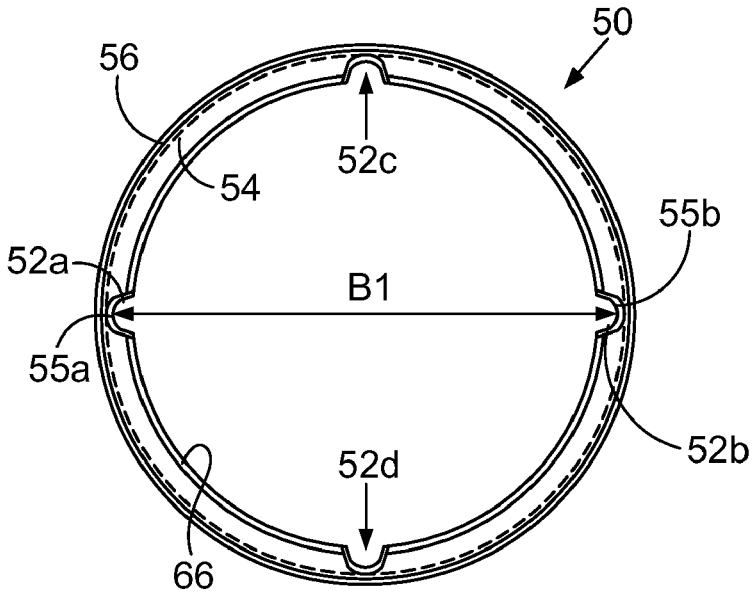
FIG. 2D is an elevation view of yet another alternative bearing member design.

FIG. 2D depicts yet another bearing member design 50 in which retention flange 34, as well as the optional guide and retention tabs are not used and notches 52*a*, 52*b*, 52*c* and 52*d* extend through the rings 54 but not into retention flanges 56 thereby establishing a smaller predetermined distance B1 between notch bottoms 52*a* and 52*b* which is smaller than distance "B". Additionally, the web portions of the flange below the bottom of each of the notches in this embodiment are thicker than web portions 40*a* and 40*b* since the notches do not extend into the flanges.

Figure 3A:
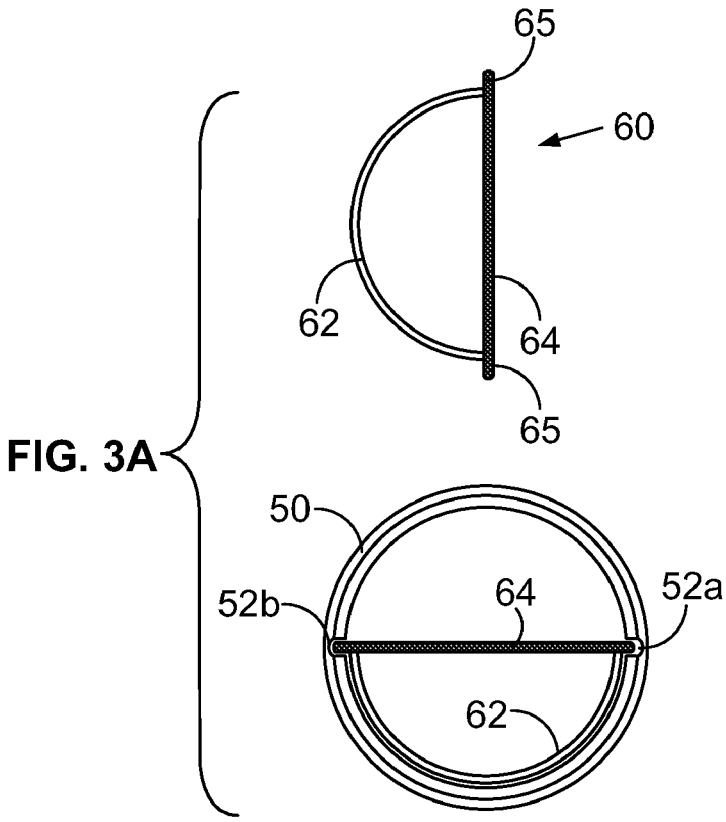
FIG. 3A includes an end elevation view of a hemispherical light-controlling member and an end elevation view of the hemispherical light-controlling member mounted in the bearing member of FIG. 2D.

FIG. 3A illustrates a hemispherical tubular light-controlling member 60 which may be used with, e.g., any of bearing members 30, 33 or 50. Light-controlling member 60 includes a clear tubular hemispherical portion 62 and a generally flat opaque or translucent barrier component 64. The opaque or translucent barrier component includes ledges 65 which extend beyond the outer surface of the tubular hemispherical portion. These ledges are dimensioned to rest in notches 52*a* and 52*b* of bearing member 50A as shown (or in the corresponding notches of bearing members 30 or 33) while the tubular hemispherical portion preferably fits within the inner wall 66 of the ring 54 of the bearing member (or the corresponding inner walls of the rings of bearing members 30 or 33).

FIG. 3B illustrates a 360° tubular light-controlling member 67 including a clear tubular component 68 and a generally flat opaque or translucent barrier component 69 which is mounted across the diameter of the tubular member. The alternative light-blocking members of FIG. 11 may also be used in lieu of component 69. Also, the micro-prismatic toothing of FIG. 12 may be employed. A bearing member that may be used with this configuration may comprise, e.g., the structure of bearing members 30, 33 or 50, but preferably will not have either notches or tabs. For example, bearing member 55 having ring 57 and flange 59 may be used. In this embodiment, the tubular light-controlling member preferably will fit snuggly against the inner wall 61 of the ring of bearing member 55 which itself will be rotatably mounted in bore 18.

When reference is made to a feature of the invention as being opaque or translucent it is intended to mean that the feature ranges from translucent (letting some light pass but diffusing it so that objects on one side cannot be clearly distinguished from objects on the other side) to opaque (letting no appreciable amount of light pass). When reference is made to "light" in the description of the present invention this term should be construed to include the spectral range of visible light (with or without the electromagnetic radiation with wavelengths below and above that of the visible light). When reference is made to a light-controlling member as being "spectral controlling" it is intended to mean that one or more selected portions of the spectrum are allowed to pass or are blocked, e.g., that a UV, IR or other wavelength range is allowed to pass or is blocked. When reference to a light-controlling member as being "reflecting" or "reflective" it is intended to mean that some or all of the incident light (including e.g., a selected wavelength range) is bent or sent back from a blocking surface of the light-controlling member.

Any light-blocking components used in the invention, such as the opaque or translucent or spectral controlling barrier components 64, 69 or 300*a*-300*o*, may be tinted to a level that produces the desired degree of light-blocking. Also, the light-blocking components may be segmented into light-blocking or opaque portions and transparent/translucent portions. For example, in 40-foot light-controlling members, the first 10 feet of one or more of each of the light-blocking components may be opaque, the next 5 feet transparent/translucent, and the last 25 feet opaque. Such a segmented arrangement might be used where it is desired to maintain a light-admitting area at all times. Also, translucent portions may be tinted. Typical tinting colors include white, bronze, green, blue and gray; although other colors may be used. Finally, light-controlling members may have one face (e.g., face 165 of light control member 150 or one face of flat portions 64 or 69) and a different treatment on the other face (e.g., face 167 of light control member 150 or the opposite face of flat portions 64 or 69). For example, one face may have a reflective surface and the other may have a diffusing surface so that the light-controlling member may be rotated into a first position in which it reflects incoming light away from the covered space and a second position in which the non-reflective surface diffuses the incoming light that strikes it.

The barrier components may include photovoltaic solar cells along their surface to generate electricity, preferably in conjunction with means for maximizing the photovoltaic output by rotating the light-controlling members to track the movement of the sun across the sky, ensuring that the photovoltaic solar cells continuously receive the maximum possible sunlight exposure. This combination provides in a single assembly both effective dynamic control of daylighting and shading and efficient electricity generation.

Figure 3C:
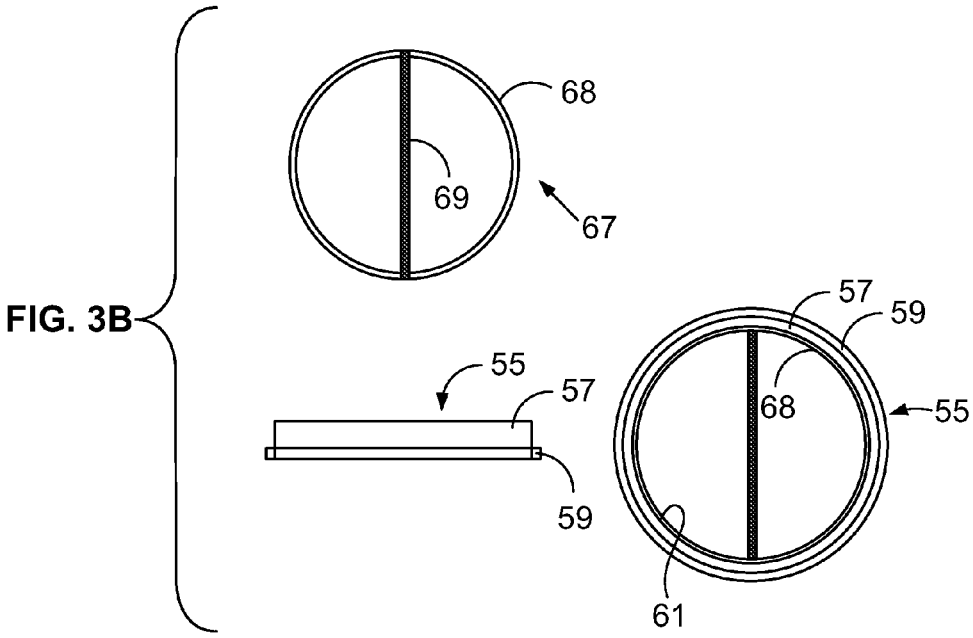
FIG. 3C is an end elevation view of yet another light-controlling member mounted in a bearing member circular bore.
Figure 3C:
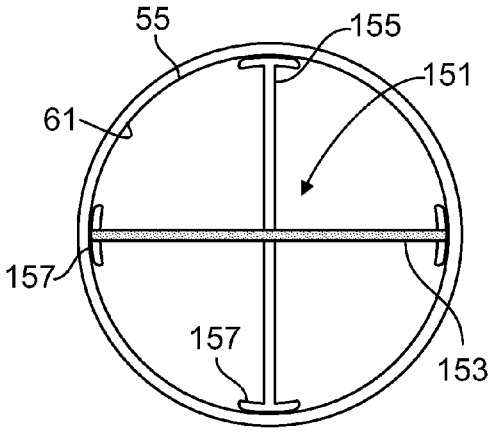

FIG. 3C illustrates yet another light-controlling member 151 comprising a pair of perpendicular cross pieces 153 and 155 which preferably are coextruded. Cross piece 153 is opaque in this embodiment, although it may, of course, have a different surface treatment, as discussed above. Additionally, feet 157 are formed at the opposite ends of the cross pieces and generally perpendicular to the cross pieces. Preferably, opaque cross piece 153 passes through the clean feet to maximize light-blocking. Feet 157, which will rest against the inner wall 74 of bearing member 55 to retain light-controlling member 151 in place, may be curved to follow the curvature of the inner surface 74 of the bearing member and preferably will be clear as shown. As a result, opaque cross piece 153 is positioned and held in place across the diameter of the bearing member and presents minimal light-blocking when light-controlling member 151 is in the fully open position.

Figure 3D:
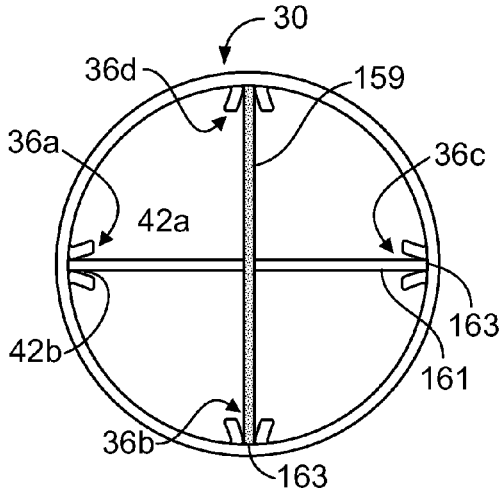
FIG. 3D is an end elevation view of another light-controlling member, mounted in the bearing depicted in FIGS. 2A and 2B.

FIG. 3D illustrates yet another light-controlling member design. This design includes cross pieces 159 and 161 which generally correspond to cross pieces 153 and 155 of FIG. 3C. In this embodiment, however, there are no feet. Rather, the ends 163 of the cross pieces fit in opposed notch bottoms 36A-36D and in the guide and retention tabs 42A and 42B of bearing member 30. It should be noted that in the embodiments of FIGS. 3C and 3D both bearing members 30 and 55 include retention flanges, but these have been removed for purposes of illustration. Other bearing designs (e.g. bearing members 30, 33, 50 or 55) may be used with this light-controlling member design.

Figure 4A:
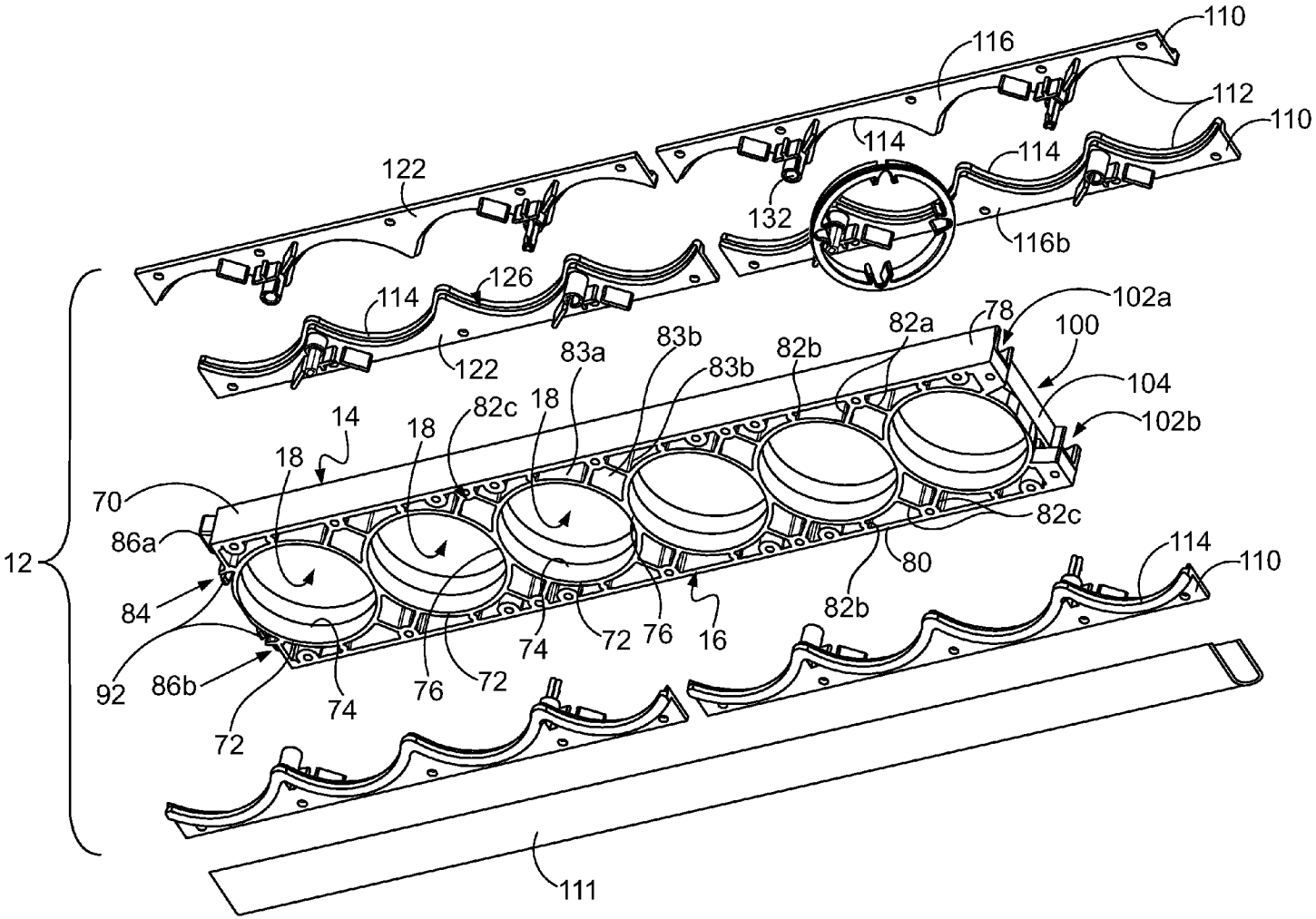
FIG. 4A is an exploded view of the light-control assembly of FIG. 1 including an optional reinforcing U-channel.

Turning now to FIG. 4A, an exploded view of light-control assembly 10 is shown, including a beam 70 at the center of the assembly having bores 18 in which the bearing members rotate. Since beam 70 in this embodiment is made by plastic injection molding for purposes of minimizing friction, weight and material usage, the beam is molded with rings 72 defining bores 18 along their inner surface 74. Adjacent rings 72 intersect on their periphery and are joined along lateral conjunction segments 76. Preferably, the beam will be made of a clear or translucent material like polycarbonate to help camouflage the light-control assembly. However, the beam may also be made by known techniques using aluminum, steel or other appropriate materials.

At least one and preferably three or more rollers or roller assemblies may be mounted on the beam about the periphery of the bores to contact the outer circular surface of the bearing members. This will help reduce friction and wear particularly in heavy usage applications, where the light-controlling members are heavy, or where it is necessary or desirable to minimize the number of light-control assemblies. Furthermore, where such rollers or roller assemblies are used they may be spaced from the front and back faces of the beam and/or undercut to create a gap for retaining the bearing members in lieu of or in addition to retainers 110 or 310 which are discussed below.

The injection molded beam illustrated in FIG. 4A also includes top and bottom strips 78 and 80, front and rear faces 14 and 16, and a series of repeating top and bottom support ribs 82*a*-82*c* defining cavities 83*a*-83*c*, as illustrated. The combination of the laterally conjoined rings, top and bottom strips, support ribs and cavities together make the beam lightweight yet give it sufficient rigidity to resist bending forces to ensure reliable operation of the light-control assembly.

The beam of FIG. 4A preferably is designed for modular applications where a series of beams having, for example, six bores that are approximately 45 mm in diameter can be easily and reliably interconnected to produce a longer composite light-controlling assembly of a desired width comprising a multiple of the width of a single light-control assembly. For example, such a modular assembly nominally 600 mm in width could be constructed and used in applications where the light-controlling members are any desired length from, e.g., up 15 meter or more.

Thus, the first end 84 of the illustrated light-control assembly 70 includes top and bottom trapezoidal projections 86*a* and 86*b* that fit into trapezoidal cavities 102*a* and 102*b*. Trapezoidal projection 86*a* and corresponding trapezoidal cavity 102*a* are shown in the partial enlarged views of FIGS. 4B and 4C. In FIG. 4C it is seen that trapezoidal projection 86*a* includes a base surface 88 protruding beyond a generally flat face 90 of beam end 84. Trapezoidal cavity 102*a* is dimensioned to receive trapezoidal projection 86*a*, so that face 88 of the trapezoidal projection is adjacent to flat bottom surface 104 of the trapezoidal cavity. Also, beam end 100 includes a flat face 104 dimensioned to abut flat face 90 of beam end 84 where the trapezoidal projection slides into the trapezoidal cavity as shown in FIG. 4C.

Additionally, flexible locking clips 92 (FIG. 4A) project from the flat surface 90 of first end 84. These clips are designed to flex inwardly as adjacent beams are moved into alignment and then to lock in place when the adjacent beams are fully laterally aligned.

Figure 4B:
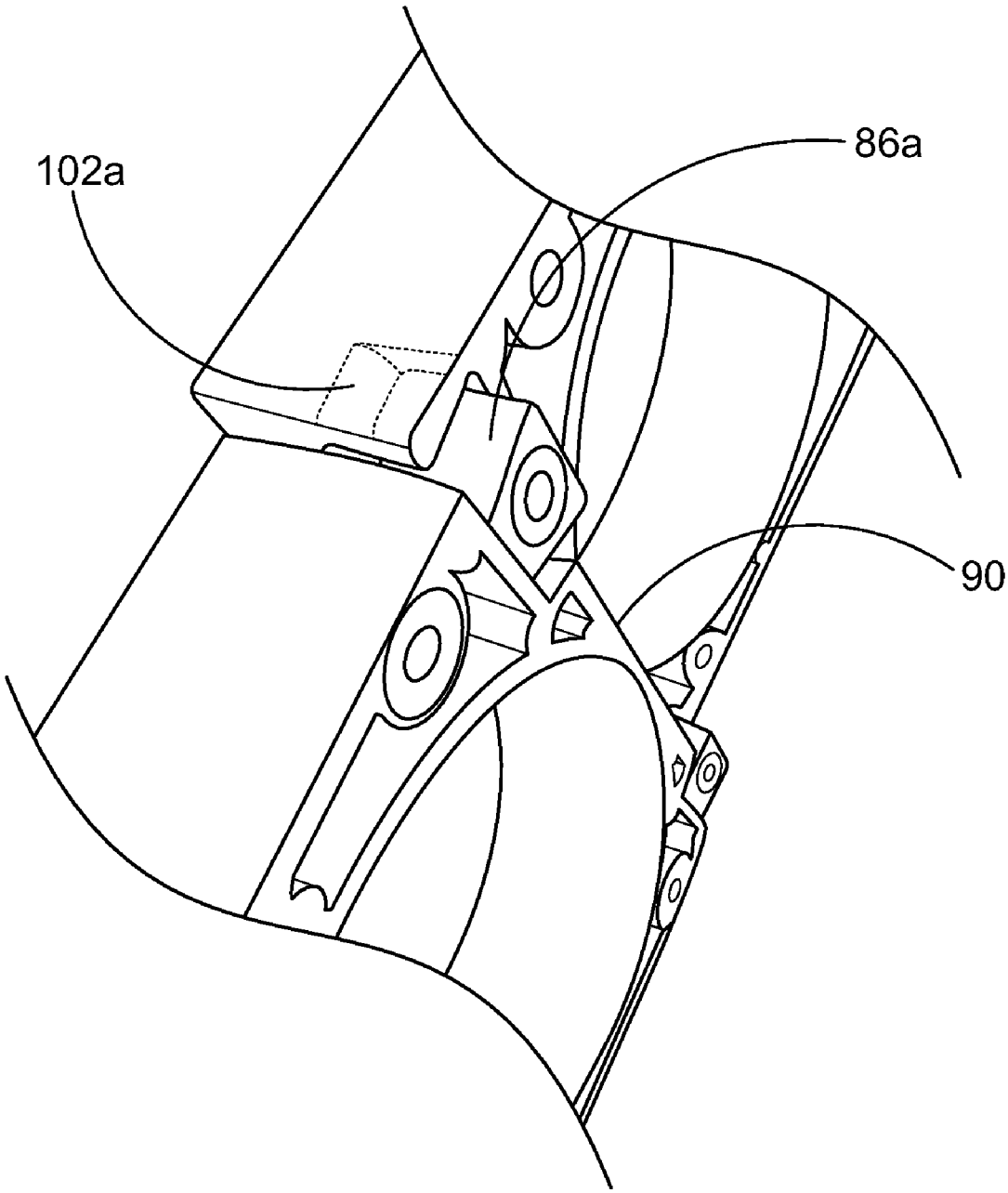
FIG. 4B is an enlarged partial perspective view showing corresponding ends of two light-control assembly beams as the beams are interlocked.
Figure 4C:
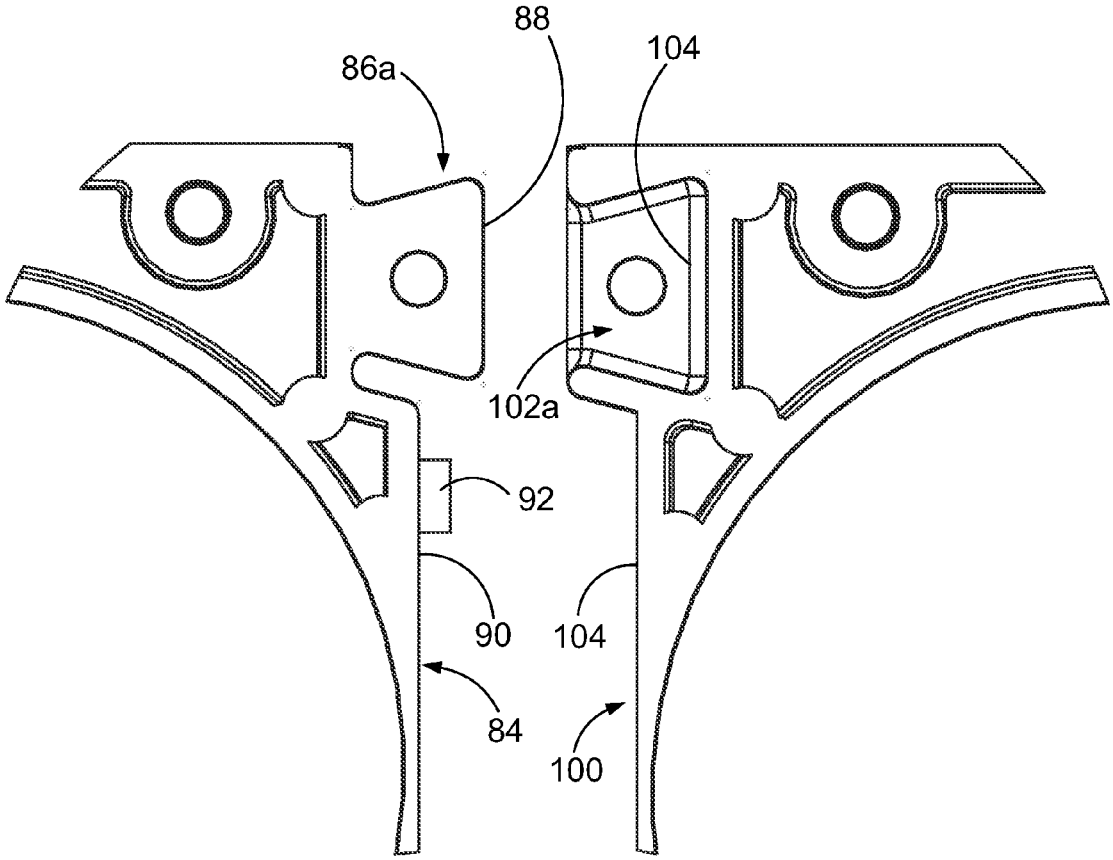
FIG. 4C is a partial elevation view of corresponding interlocking ends of two beams of the light-control assembly of FIGS. 1 and 4A.

The trapezoidal projections are aligned and moved into their corresponding trapezoidal cavities as illustrated in FIG. 4B. When corresponding front and back faces 14 and 16 of the beams are aligned, clips 92 will snap into place locking the adjacent beams together. Thus, any number of beams may be locked together in this way to modularly produce an overall light-control assembly of the desired width.

Once the desired number of beams is assembled along with the other components of the light-controlling assembly an optional reinforcement member may be applied across the top and/or the bottom edges of the assembly. For example, a metal U-channel 111 (FIG. 4A) may be used for this purpose. Such a reinforcement member may also be used to attach the light-control assembly to existing structure under or over glazing or opened unglazed areas using appropriate profiling members. Finally, appropriate holes may be located in the reinforcement member in alignment with bores 121 in the beam and corresponding holes 123 in retainers 110 (see below) and appropriate fasteners (not shown) may be used to insure reliable attachment.

Light-control assembly 10, in the illustrated embodiment, also includes pairs of front and back retainers 110 which are designed to be oriented as shown and attached to the front and back faces 14 and 16 of the beams to retain the bearing members. The offset bearing members are thus coupled to the beam by trapping the retention flanges of the bearing members between front and back faces of the beam and the back surfaces 116 of the retainers. (The top front retainer was removed from FIG. 4A to facilitate viewing of the overall assembly.) Retainers 110, in the illustrated embodiment, have a scalloped edge with a series of semi-circular openings 112 each having an inner surface 114 of a diameter corresponding to that of bores 18. As in the case of the beams, the retainers preferably will be made of a transparent or translucent material like polycarbonate to help camouflage the light-control assembly, but can be made of any desired material.

Figure 5A:
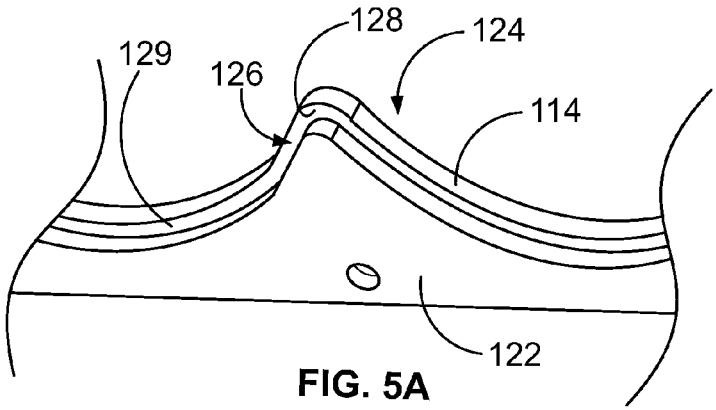
FIG. 5A is a partial perspective view of portions of two adjacent scallops of a retainer of the light-control assembly of FIGS. 1 and 4A.

As best seen in FIG. 5A, the back sides 122 of the retainers include a ridge 124 with inner surface 114 corresponding to the inner surface 19 (FIG. 1) of bores 18 and an undercut 126 behind the ridge creating a back face 128 and an annular cavity 131 dimensioned to receive and trap flange 34 of the bearing members without impeding rotation of the bearing members. Thus, the flanges of the offset bearing members are captured in the curved undercuts 126 of retainers 110. Alternatively, such undercuts may be formed in the face of the beam about the circumference of bores 18 to serve the same function as retainer undercuts 126 which may instead have a flat inner surface 114 in such an arrangement. In yet another alternative, both the surface of the beam and the inner surface of the retainer may be undercut so that these undercuts can cooperate in capturing the flanges of the bearing members in place in the light control assembly.

Beams 300 and 402 may be adapted for modular assembly like beam 70 by providing appropriate interlocking means at the ends of the beams.

Additionally, as best seen in FIG. 5B tabs 120*a*, 120*b* and 120*c* project generally perpendicularly from the retainer back surfaces 116 and are positioned and dimensioned to fit in cavities 83*a*, 83*b* and 83*c* of the beam to ensure proper positioning of the retainers on the beams.

Figure 5C:
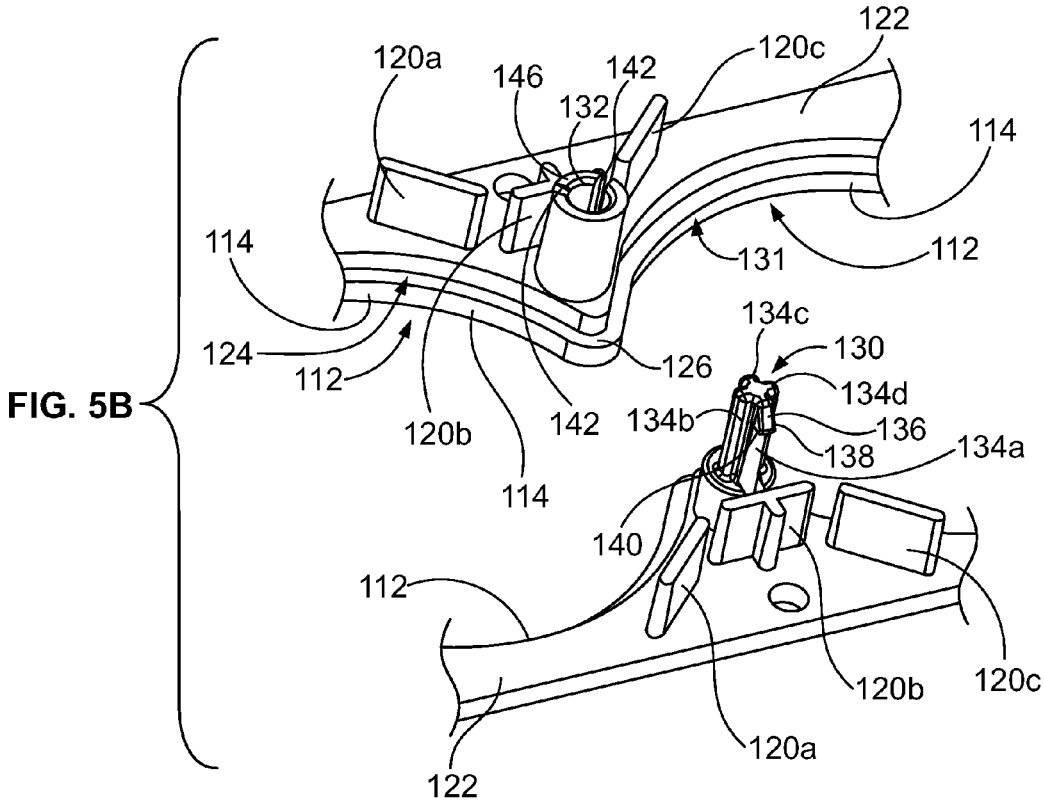
FIG. 5C is a partial elevation view of the mechanism by which the locking pins and locking cavities of FIG. 5B mate.
Figure 5C:
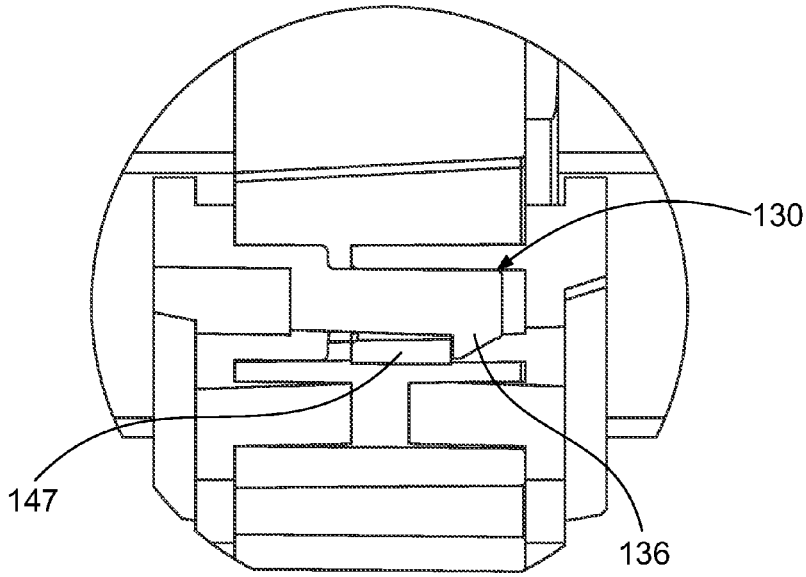

Finally, retainers 110 include alternating locking pins 130 and locking cavities 132 which are disposed on the backside of the retainers so that when retainers are positioned on opposite sides of the beam, the locking pins and locking cavities are aligned and paired up so that they can interconnect. These locking pins and locking cavities are illustrated in an enlarged form in FIG. 5B. A pair of fully interlocked pins and cavities is illustrated in the cross-sectional view of FIG. 5C.

Locking pins 130 include ribs 134*a*-134*d* which project in diametrically opposite directions and have outer edges that are dimensioned to rest securely within locking cavity 132. Additionally, bottom rib 134*d* includes a nose portion 136 having a ramp surface 138 and a locking face 140. Locking cavities 132 also include a tubular portion with longitudinal slits 142 defining a top flexible tubular portion 146.

Thus, when retainers 110 are properly positioned on opposite faces 14 and 16 of the beam with ribs 120A-120C aligned with cavities 83*a*-83*c* and locking pins 130 aligned within locking cavities 132, the retainers are pressed together until they rest against the opposite faces of the beam. Nose portion 136 is positioned and dimensioned so that as it moves into cavity 132 the top flexible tubular portion 146 flexes upwardly as the nose portion flexes downwardly until the nose portion hooks onto a latch bar 147 whereupon the locking pins lock in the cavities affixing the retainers onto the front and back of the beam. Additionally, when multiple beams are joined together, the retainers will be offset as shown in FIG. 4A to cover the seams between adjacent interlocked beams and enhance the security of the attachment.

However, before the assembly of the retainers onto the beams is completed, a first bearing member 30 is mounted in a first bore such as bore 18*a* of FIG. 1 with its flange 34 adjacent the first beam face 14 and its ring extending into the bore. The next bearing member is mounted in the next adjacent bore such as bore 18*b* of FIG. 1 with its flange adjacent the second beam face 16 and its ring extending into the bore. The bearing members are mounted in each successive bore in this alternating fashion, so that looking atone of the faces of the beam, the flanges are at the front of every other bore. Looking at the opposite face of the beam, the flanges will be in the remaining alternate bores. This insures that the flanges in adjacent bores will not interfere with each other. In one alternative embodiment of the invention the retainers may be secured to the beams with screws or other fasteners that pass through holes 123 in the retainers and into bores 121 in the beam which are aligned with the holes.

Figure 13A:
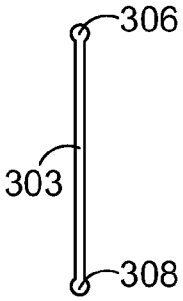

FIGS. 13-16 illustrate an alternative light control assembly design. This light control assembly includes a generally flat alternate beam design 300 of FIGS. 13 and 13A having a series of circular bores 302 which pass through the central section of the beam 303 and define web portions 304 between the bores. Top and bottom ribs 306 and 308 are located at the top and bottom of the central section of the beam.

Figure 14:
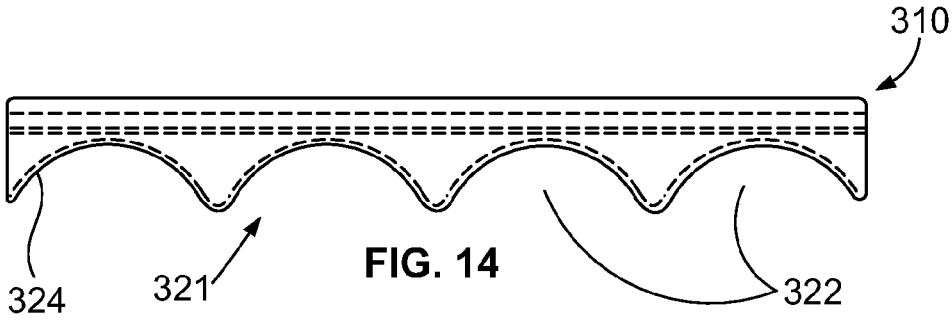
FIG. 14 is a front elevation view of an alternative retainer design intended to be used with the beam of FIGS. 13 and 13A and FIG. 14A is a side elevation view thereof.
Figure 14A:
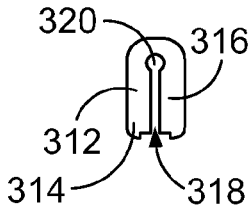

FIGS. 14 and 14A depict an alternative U-shaped retainer design 310. Retainer 310 as best viewed from its end 312 includes a front leg 314 and a back leg 316 defining an opening 318 between the two legs. A channel 320 is formed at the top of opening 318 to receive top rib 306 of beam 300. Retainer 310 also includes scalloped edge 321 with circular openings 322 corresponding in diameter to the diameter of bores 302. As in the case of retainer 110, retainer 310 is undercut at 324 to receive bearing member 326 as will be explained below.

Figure 15:
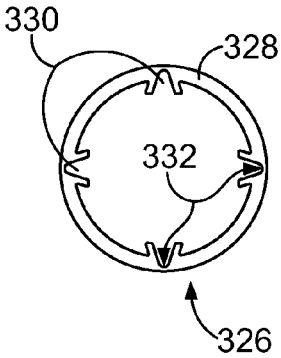
FIG. 15 is a front elevation view of an alternative bearing member design intended to be used with the beam of FIGS. 13 and 13A and FIG. 15A is a side elevation view thereof.
Figure 15A:
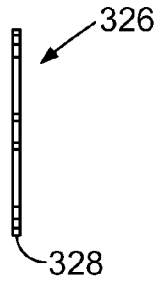

Bearing member 326 comprises a flat annular ring 328 with pairs of diametrically opposed notches 330 having opposed notch bottoms 332 generally corresponding to notches 36*a*-36*d* and notch bottoms 38*a*-38*d* of bearing members 30. Bearing member 326 also includes a circular outer edge 334 as depicted in FIG. 15A.

Figure 16A:
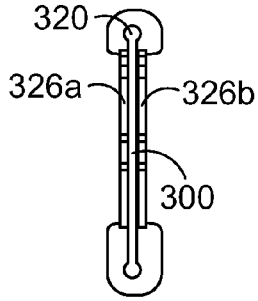
FIG. 16A is a cut-away view of the assembly of FIG. 16 taken along lines 16A-16A in FIG. 15.
Figure 16:
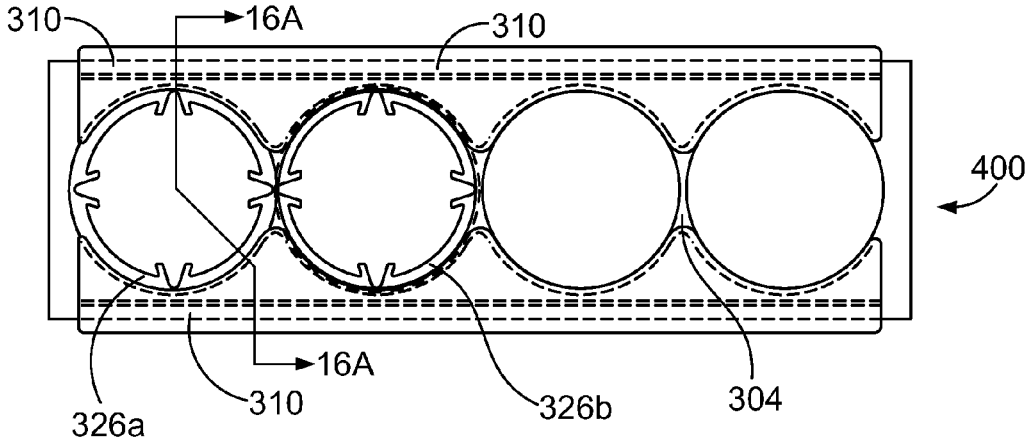
FIG. 16 is a front elevation view of an alternative light control assembly containing the beam, retainer and bearing members of FIGS. 13-15

A fully assembled alternate light control assembly 400 is shown in FIGS. 16 and 16A. This assembly is constructed by aligning bearing members 326*a* and 326*b* with adjacent bores 302 with each adjacent bearing member offset with respect to its adjacent bearing member(s), i.e., on opposite sides of the beam. The rings preferably overlap the web portions between adjacent bores. With the bearing members positioned in this way retainers 310 are pressed down upon the top and bottom ribs of beam 300 to generally spread the legs of the retainer until the ribs come to rest in channels 320 whereupon the legs of the retainer snap back in place, locking retainers to the top and bottom ribs of the beam and thereby capturing the offset-positioned bearing members in assembly 400. As can be seen in FIG. 16, the outer edges of the bearing members are captured within undercuts 324 (FIG. 14) in retainers 310. In a yet further alternative embodiment, such undercuts may be provided along the outer edge of bores 302 in lieu of or in addition to undercuts 324 of the retainers to perform the same retention function.

Figure 17:
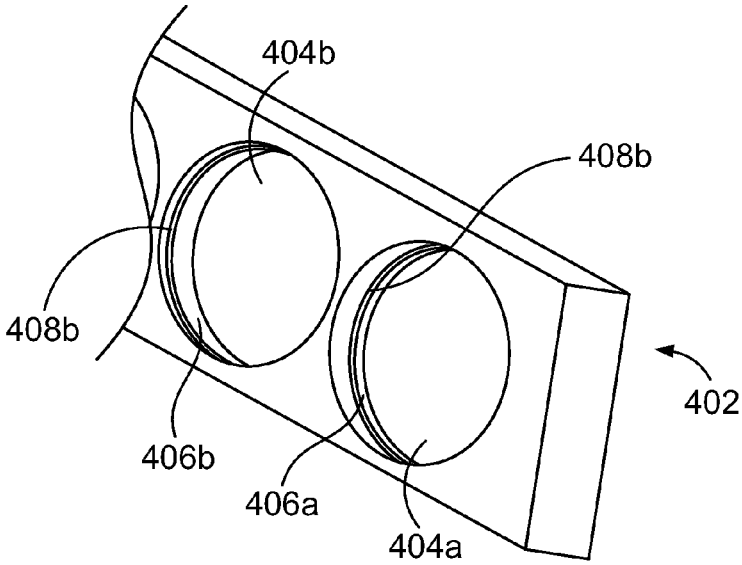
FIG. 17 is a partial perspective view of an alternative beam design designed to capture bearing members within off-set bore grooves.

Turning now to FIG. 17, an alternate beam design 402 is shown with bores 404*a* and 404*b*. These bores have respective inner surfaces 406*a* and 406*b* with circular grooves 408*a* and 408*b* that are offset with respect to each other as shown. This beam will thus accept and retain, e.g., bearing members 30, 33, 50, 55, and 326. In the case of all but bearing member 33, the bearing members will be forced into the bore grooves. Slot 35 in bearing member 33 is therefore preferred in the sense that relief slot 35 makes it easier to squeeze this bearing member together before insertion released so that when it is released flanges 34 will rest in the appropriate grooves to complete the assembly. Similar relief slots or other relief means may be provided in any bearing member intended to be mounted in bores 404*a* and 404*b*. Additionally, it is noted that when using a beam design like that of beam 402, the bearing member flanges may be shifted from the outer ring edges to intermediate locations along the outer surfaces of the annular rings of the bearing members to engage grooves 406*a* and 406*b*.

Figure 6A:
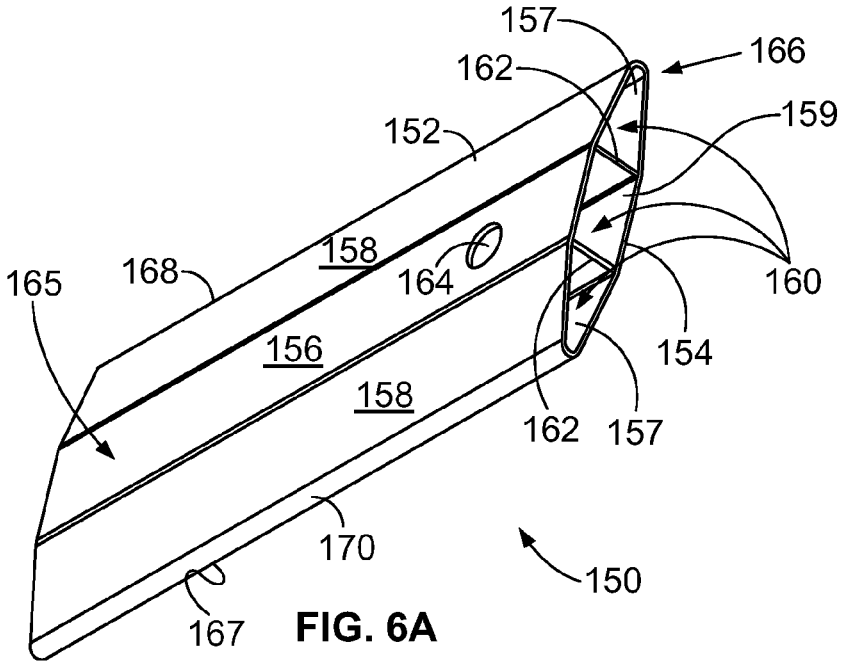
FIG. 6A is a perspective view of a light-controlling member which may be used in the invention.
Figure 6B:
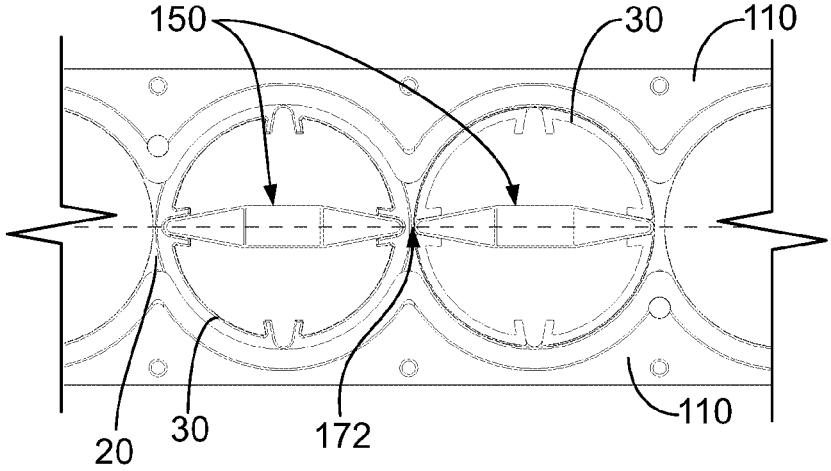
FIG. 6B is a partial front elevation view of a portion of the light-control assembly of FIG. 1 in which light-controlling members depicted in FIG. 6A are mounted in place in the assembly and rotated to a fully closed position.
Figure 8:
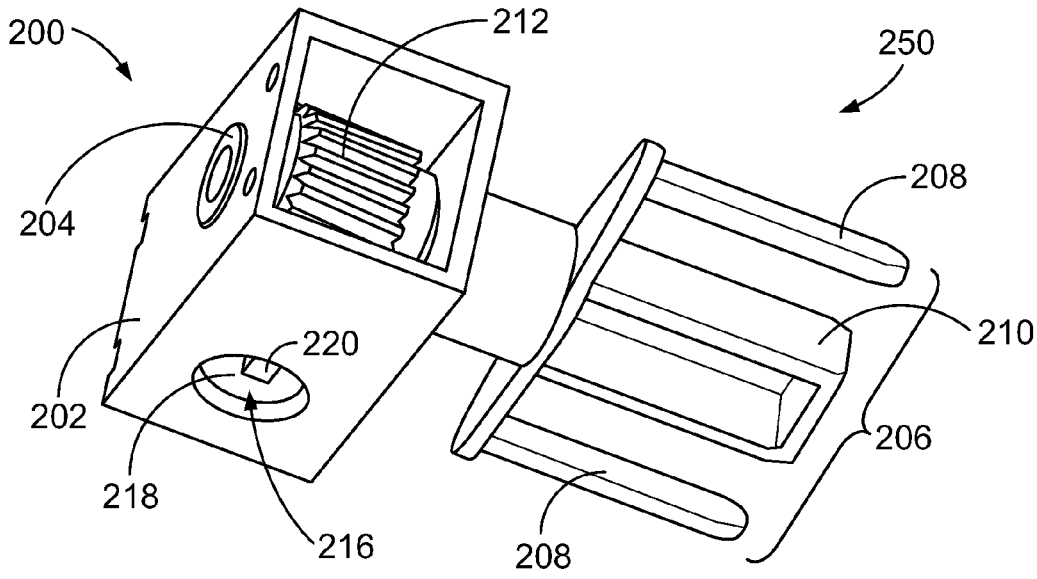
FIG. 8 is a perspective view of a drive mechanism that may be used in the invention to rotate adjacent light-controlling members.

Light-controlling members such as slats 150 of FIGS. 6A and 6B may be mounted in the bearing members described above. Slats 150, in the illustrated embodiment, are plastic extruded to form top and bottom walls 152 and 154. Walls 152 and 154 are each made up of a central segment 156 and lateral segments 158 which define lateral cavities 157 and central cavity 159. The slats may be opaque or translucent. An air space 160 is maintained between the top and bottom walls by forming ribs 162 which, in the illustrated embodiment, are disposed perpendicularly at the lateral edges of central segment 156. Slat 150 also has a front face 165 and a back face 167. Also, in the illustrated embodiment, holes 164 are formed in the central segment adjacent the drive end 166 of the slats to facilitate locking the slats to a drive mechanism 250 as shown in FIG. 8, as discussed below. This segmented configuration gives the slats important rigidity characteristics while maintaining light weight and producing minimal interference with light transmission when the assembly is in a fully open position.

The illustrated configuration of slats 150 (as well as slats 151 and 166) gives them longitudinal, torsional, and deflection rigidity, which is desirable in the practice of this invention. The term "torsional rigidity" is intended to refer to the ability of the slats to resist deformation when forces are applied to rotate them within the light-control assembly. "Longitudinal rigidity" is intended to refer to the ability of the slats to withstand deformation or deflection when a force is applied generally along the longitudinal axis of the slats such as when the slats are slid into the light-control assembly, as will be described in more detail below. "Deflection rigidity" is intended to refer to the ability of the slats to withstand bowing under the force of gravity or other forces which act generally perpendicularly to the longitudinal axis of the slats.

The top and bottom walls of slat 150 join together to form top and bottom edges 168 and 170. In the illustrated embodiment, these edges are dimensioned to fit into the opposed slots 36*a* and 36*b* of bearing members 30 although they may, of course, be used with other bearing member designs. Thus, when the mounted slats are rotated into the closed configuration illustrated in FIG. 6B light will be able to pass only in the gap 172 between the adjacent slats.

Figure 6C:
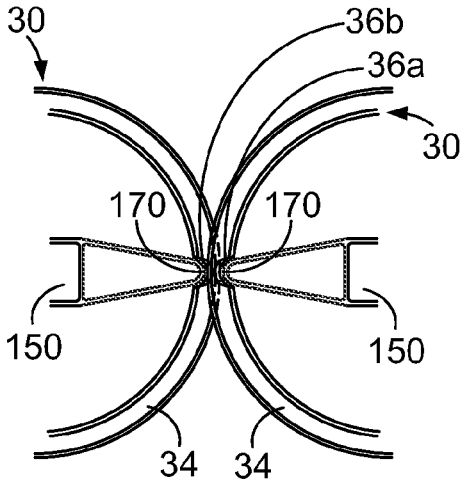
FIG. 6C is partial front elevation view of two light-controlling members as depicted in FIG. 6A highlighting the close-fitting relationship of the member edges when the light-controlling members are in the fully closed position.

FIG. 6C is a diagrammatic representation of two slats 150 resting within slots 36*a* and 36*b* of bearing member 30 (FIG. 2B). In this diagrammatic representation retention flange 34 of the left bearing member will rest against back face 16 of beam 70 while retention flange of the right retention flange 34 of the right bearing member will rest against front face 14 of beam 70. Since the retention flanges of the bearing members are offset in this fashion they do not interfere with each other and thereby make it possible to bring corresponding edges 170 of the two slats far closer together than has been conceived of or implemented in any prior art light-control device.

Figure 6D:
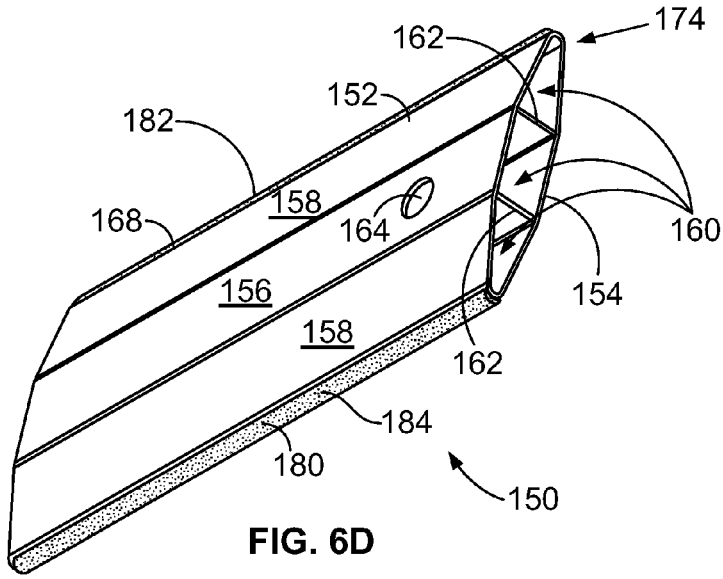
FIG. 6D is a perspective view of an alternative embodiment of the light-controlling member of FIG. 6A in which elastomeric materials is provided along the edges of the light-controlling member.
Figure 6E:
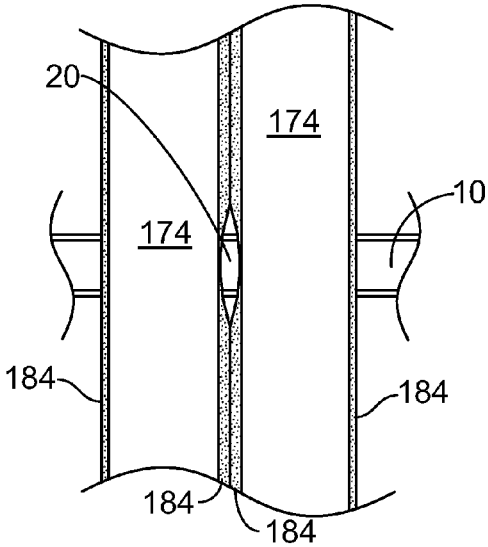
FIG. 6E is a top partial view of two adjacent light-controlling members as depicted in FIG. 6D in the fully closed position, with the top of the light-controlling assembly removed to facilitate the depiction.
Figure 6F:
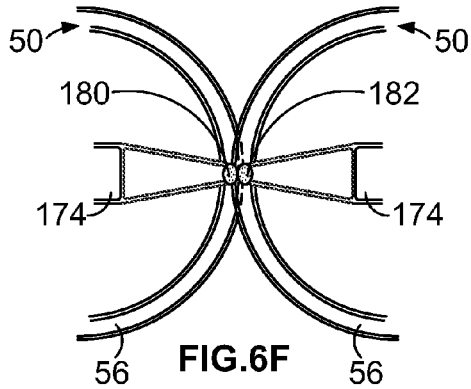
FIG. 6F is partial front elevation view of two light-controlling members as depicted in FIG. 6D highlighting the close-fitting relationship of the member edges in the fully closed position.

In an alternate embodiment of the invention, slats 174 of FIG. 6D will be provided with deformable top and bottom edges 180 and 182 as illustrated in this Figure by extruding deformable edge shapes, co-extruding flexible edges or otherwise attaching deformable strips 184 to top and bottom edges 180 and 182. Thus, when these slats are in a fully closed position corresponding generally to that depicted in the partial overhead view of FIG. 6E virtually all of the space between adjacent slats will be closed off by the deformable edges as illustrated. FIG. 6F is a diagrammatic representation corresponding generally to FIG. 6D which highlights the contact between deformable edges 180 and 182 of slats 174 made possible by offsetting the retention flanges of the bearing members on opposite sides of the beam.

Slats 150 and 174 may include photovoltaic solar cells to general electricity, preferably in conjunction with means for maximizing the photovoltaic output by rotating the light-controlling members with movement of the sun across the sky to insure that the photovoltaic solar cells continuously receive the maximum possible sunlight exposure while providing daylighting into the space below.

Figure 7:
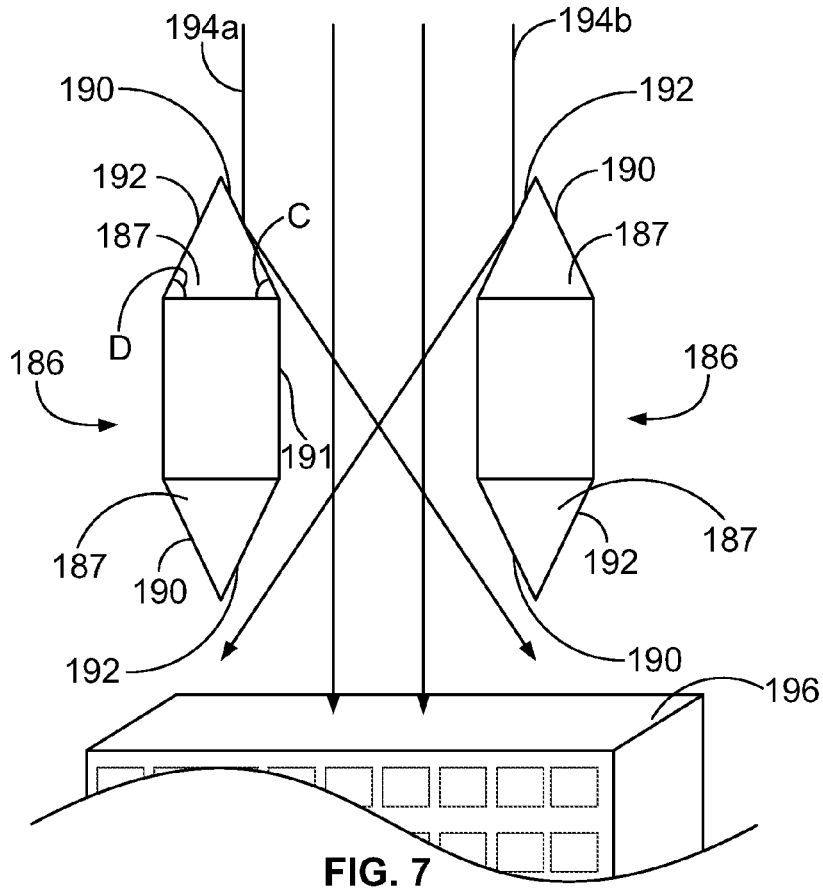
FIG. 7 is a diagrammatic representation of two light-controlling members fitted with reflective surfaces to maximize light transmission when the light-controlling members are in the open position.

FIG. 7 illustrates another important feature of the slats of the invention with respect to slat design 186 in which, for purposes of illustration, triangular top and bottom segments 187 with opposite beveled faces 190 and 192 are emphasized. Angles "C" and "D" of triangular top and bottom segments 187 preferably should be greater than 45 degrees. Slats 186 may be fit within bearing members in the same fashion as slats 150 and 174, described above. In accordance with the teaching above, segments 190, 191 and 192 (and preferably the corresponding segments on the opposite face of the slat) will be opaque, translucent, spectral controlling or reflective. Thus, when slat 186 is in the fully open position illustrated in this figure and segment 190 has a reflective surface most of the incoming light hitting that surface will be reflected into the area below shown diagrammatically as an enclosed area 196. When segment 190 is, e.g., white opaque, an estimated 60% of the incoming light hitting that surface will be reflected into the area below. Finally, when segment 190 is translucent an estimated 30% of the incoming light hitting that surface will be reflected into the area below. This is depicted diagrammatically in FIG. 7 which shows light rays 194*a* and 194*b* striking surfaces 190 and 192 of adjacent open slats and being directed downwardly to the area below the slats. Of course, when the slats are rotated 90 degrees to their closed position, they will block, reflect, etc. some or all of the incoming light, as described earlier.

Finally, it is noted that the light-reflective surfaces of segments 190, 191 and/or 192 may be micro-prismatic reflective surfaces. Total light enhancement can be achieved by positioning such micro optical prisms to tunnel additional light into the interior space below the light-controlling members.

A drive mechanism 200 that may be used in the invention is illustrated in FIG. 8. The drive mechanism includes a gear box 202 having a shaft 204 with a mounting comb 206 having tines 208 positioned and dimensioned to fit within lateral cavities 157 of slat 150 and a central member 210 dimensioned and positioned to fit within the central cavity 159 of slat 150 (FIG. 6A). The mounting comb thus retains the slat on the drive mechanism. Central member 210 may also have a projection (not shown) that fits in hole 164 of the slat to lock the slat onto the comb.

Worm gear 212 (mounted onto shaft 204 of the mounting combs) meshes with an internal worm (not shown) having a circular axial cavity 216 with a key 218. Thus a rotation shaft 22 with a corresponding slat to receive key 218 is designed to be passed through cavities 216 of drive mechanisms 200 associated with each of a series of slats in a modular light-control assembly. As a result, rotation of the shaft will produce corresponding and coordinated rotation of all of the slats associated with drive mechanisms attached to the shaft.

Figure 9:
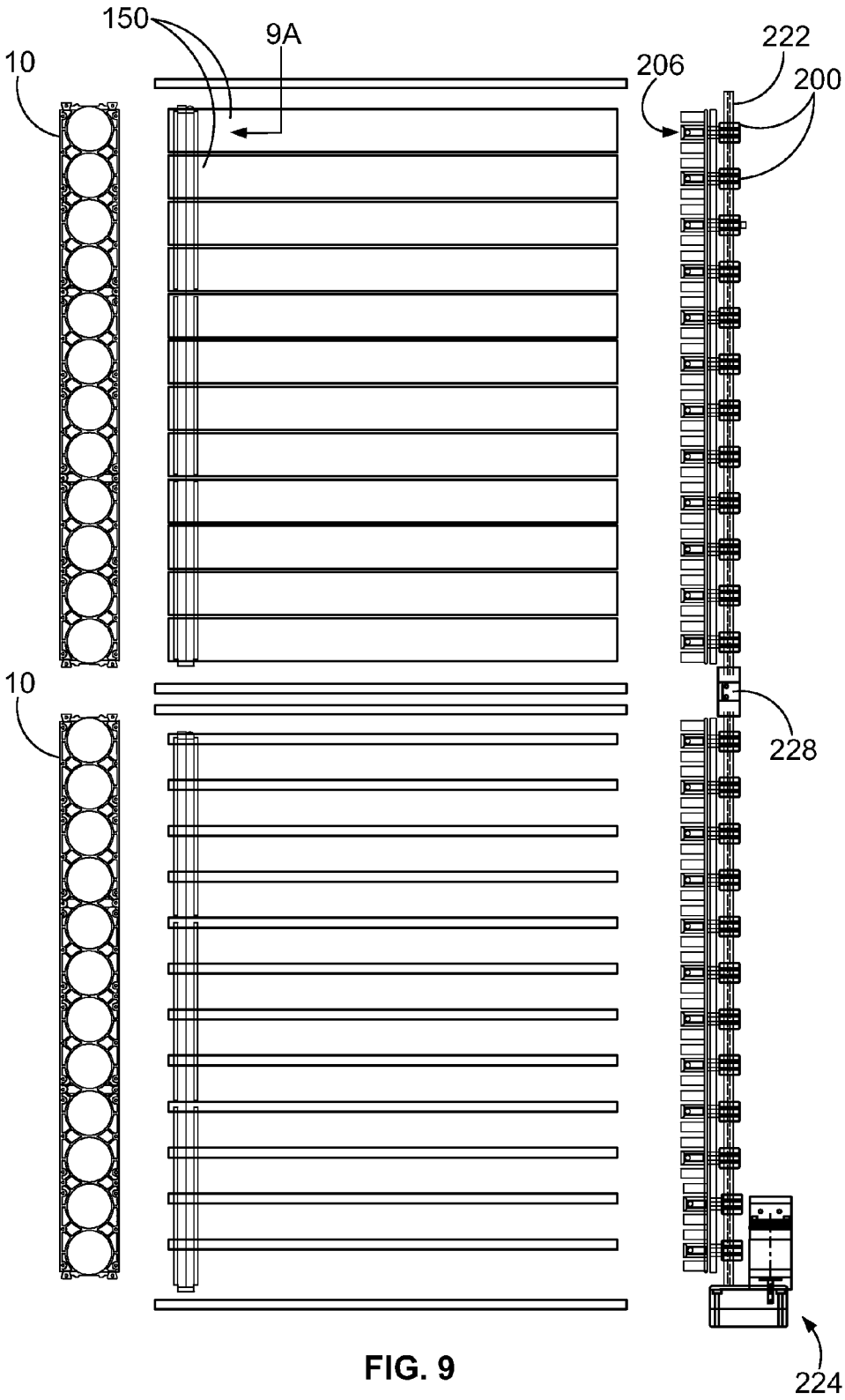
FIG. 9 is a diagrammatic representation of an installation including drive gears, light-controlling members in open and closed positions, light-controlling assemblies and associated side framing.
Figure 9A:
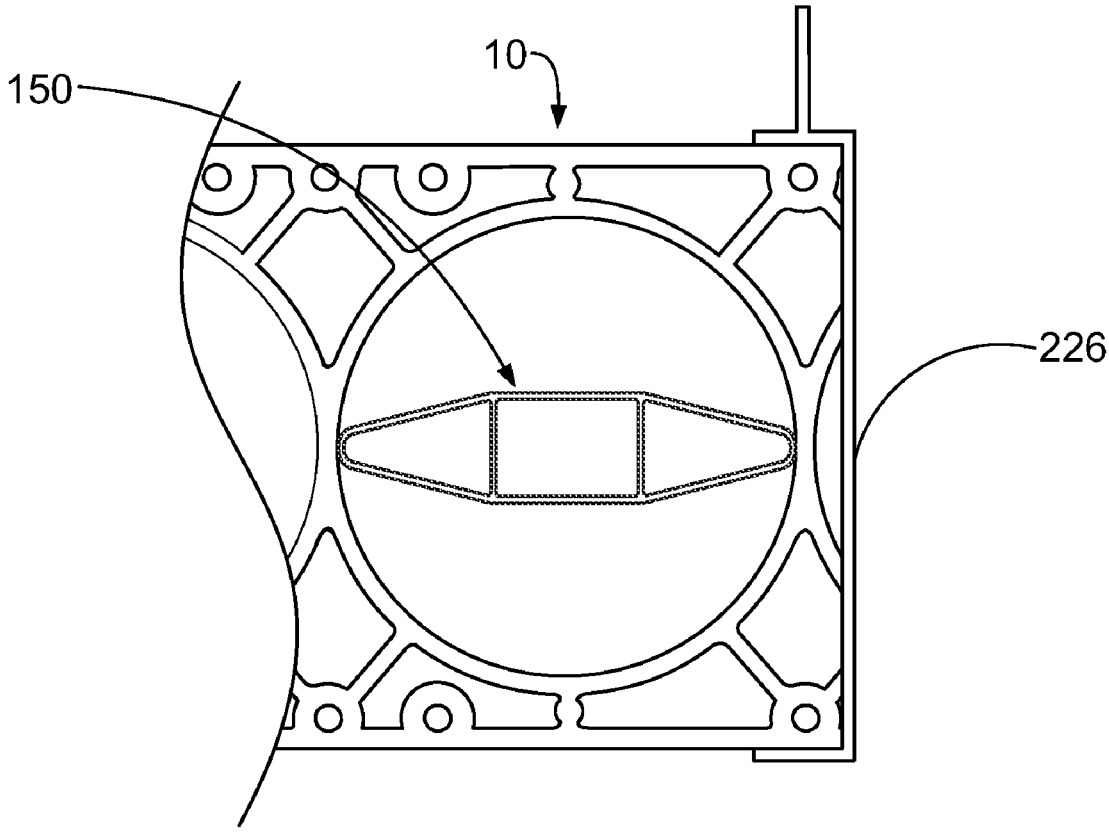
FIG. 9A is a partial end view taken along line 9A of FIG. 9 of a light-control assembly beam mounted in a side beam.

This is illustrated in FIG. 9 which shows, at the top of the figure, a series of 12 slats 150 in the closed position above a series of 12 slats in the open position at the bottom of the figure. The slats are supported in a light-control assembly 10 which is shown at the left of the figure, rotated 90 degrees to better view of the light-control assembly. In fact, a series of such light-control assemblies will be spaced along these slats at appropriate distances to ensure that the slats are maintained properly in position. The light control assemblies can be mounted in side beam 226 as shown in FIG. 9A. It should also be noted that each light-control assembly 10 in this figure comprises two beams, each having six circular bores 18 joined at their corresponding trapezoidal projections and trapezoidal cavities, as discussed earlier.

Looking to the right top of FIG. 9, a series of 24 drive mechanisms 200 is shown each with mounting combs 206. While the mounting combs are shown removed from the slats for purposes of illustration, in operation the mounting combs, of course, will be positioned in the ends of the slats, as described earlier. Finally, shaft 222 passes through keyed circular openings 218 in each of the drive mechanisms. Thus, a motor 224 attached to the shaft can be used to simultaneously rotate all of the slats. Finally, connectors 228 may be used to create as wide assembly as needed by connecting a series of shafts 222. For example, in one modular single motor design, an assembly of 40' wide×40' long can be constructed with up to 240 slats operated by a single motor.

Figure 10A:
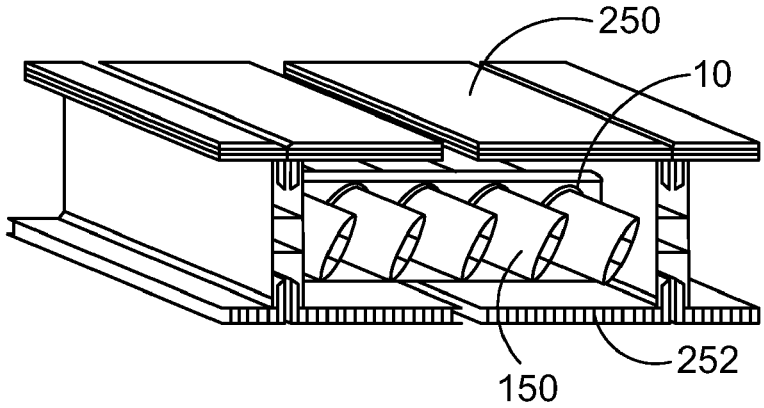
FIGS. 10A-10F are diagrammatic representations of applications of a light-control assemblies in accordance with the present invention (without light-control assembly details) mounted respectively between top and bottom glazing, below a top glazing, below a skylight, vertically, in inclined applications; and in curved applications.
Figure 10B:
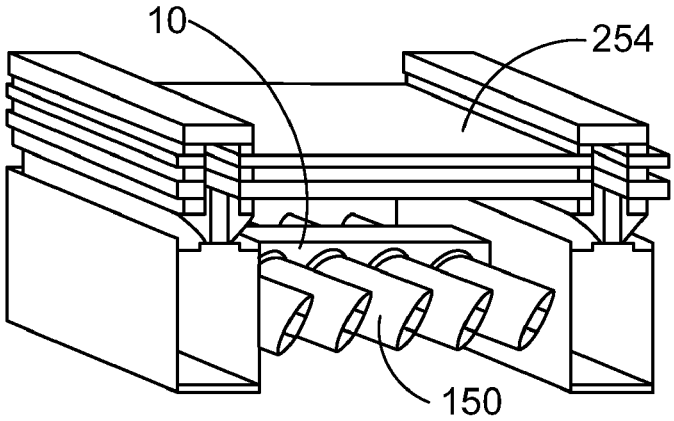
Figure 10C:
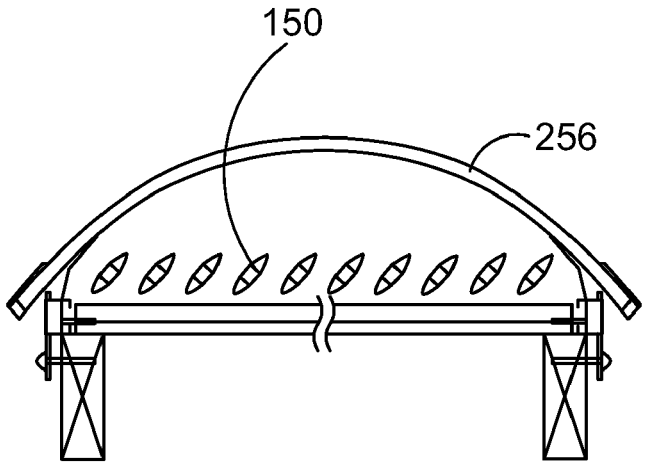
Figure 10F:
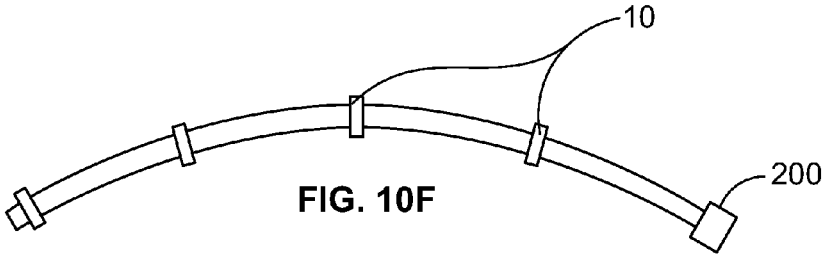
Figure 10D:
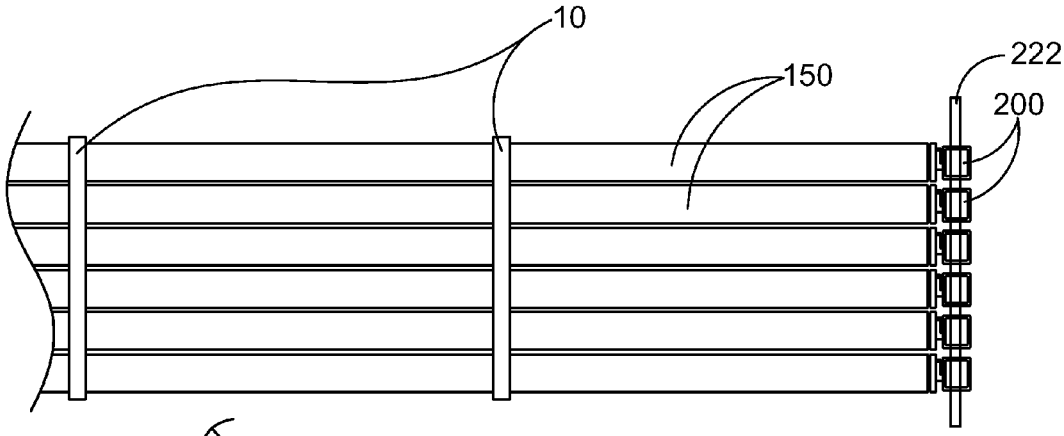
Figure 10E:
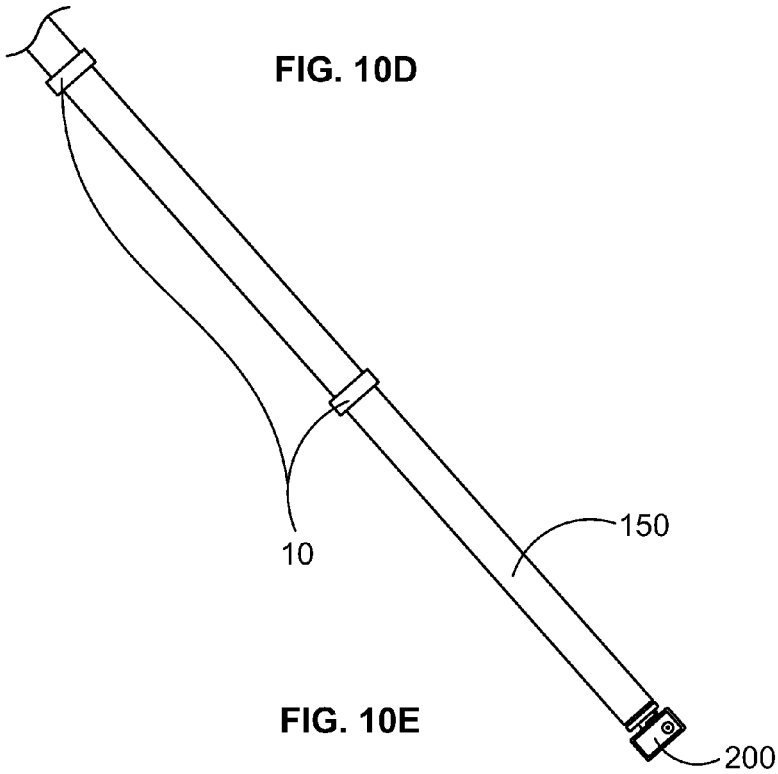

A light-control assembly 10 in accordance with the invention (such as that of FIG. 1) may be used in a variety of different applications. For example, it may be mounted between clear or translucent panels 250 and 252 as in the embodiment of FIG. 10A. Alternatively, the light-control assembly may be mounted under a clear or translucent sheet 254 as shown in FIG. 10B (or it may be mounted over a clear or translucent sheet). Additionally, the light-control assembly may be mounted under a skylight 256 as shown diagrammatically in FIG. 10C. Alternatively, a light-control assembly may be disposed vertically as shown in FIG. 10D or at inclined angle as shown in FIG. 10E. In yet other embodiments, the light-control assembly may be used in curved applications, as depicted in FIG. 10F. Although the depictions of FIGS. 10D-10F are comprised only light-controlling members 150 and supporting light-control assemblies 10, they may be used with any appropriate light-controlling members and they may be disposed under, over or adjacent to clear or transparent sheets or between pairs of clear or transparent sheets. Finally, the light-control assembly may be used without clear or translucent sheets or panels to shade open unglazed areas.

Panels and sheets 250, 252, 254 and skylight 256 may be made of various transparent and translucent materials, including, but not limited to, plastics (including, e.g., polycarbonates and acrylics), fiberglass, perforated metal fabric, or glass. In one preferred embodiment, a Pentaglas® honeycomb polycarbonate translucent panel available from CPI Daylighting Inc. (Lake Forest, Ill.) will be used in these applications. These polycarbonate panels, which are described in U.S. Pat. No. 5,895,701 (incorporated herein by reference), have an integral extruded honeycomb structural core consisting of small honeycomb cells approximately 0.16 inch by 0.16 inch which provides internal flexibility to absorb expansion and minimize stress and resists impact buckling. The resulting design offers smaller spans between rib supports, resulting in stronger durability, as well as superior light quality, visual appeal, higher insulation and excellent UV resistance. The internal flexibility of the panels absorbs thermal expansion through the panel in all directions (on the x, y, and z axes). This minimizes stress in all directions and preserves dimensional stability. The panels also have a high impact absorbing and load bearing property, a good ratio of weight to strength, and UV protection on both sides of the panel. The superior light diffusion capabilities ensure excellent quality of natural light. The panels are environmentally friendly, non-toxic, and made of 100% recyclable material.

Also, the light-control assembly may be provided with automatic sun tracking, with appropriate embedded programming that senses the daylight outside and manages the level of light and solar heat gain inside based on the level of sunlight outside. This will enable users to control natural daylight and comfort levels in any space—whether covered by glazing or not—all day long, and all year long, simply by setting desired light levels.

The beam, retainers, and light-controlling members may be made of any desirable material. In one preferred embodiment, these components may be injection molded from polycarbonate resins or acetyl. Preferably at least the bearing members and more preferably all of the components of the light-control assembly will be molded from polytetrafluoroethylene-infused polycarbonate resins. Also, although in the illustrated preferred embodiment the beam, bearing members, retainers, and slats are injection molded, one or more of these components may be made in other ways and may be made of other materials, as appropriate. For example, beam 70 may be made of punched aluminum.

A light-control assembly generally as in FIG. 1 may be assembled as follows:

1. A beam 70 is provided and a series of bearing members, such as bearing members 30, mounted in the bores of the support member with the retention flanges of adjacent bearing members alternating from face to face of the beam (and thus offset) so that no two flanges are adjacent each other on the same face of the beam and the flanges preferably overlap the web portions between adjacent bores.

2. Retainers 110 are positioned on opposite faces 14 and 16 of the beam so the tabs 120*a*, 120*b* and 120*c* of the retainers fit in cavities 83*a*, 83*b* and 83*c* of the beams and locking pins 130 are pressed home in locking cavities 132. The retainers are thus locked to the beam with the retention flanges of the bearing members trapped between the back face 129 of the retainer on the opposite faces of the beam.

3. Optionally, the desired number of light-control assemblies 10 are interconnected by aligning trapezoidal projections 86*a* and 86*b* at one end of the beam of each assembly with trapezoidal cavities 102*a* and 102*b* at the other end of the adjacent beam whereupon the projections are slid into the cavities until the adjacent beams lock together, as described earlier, to form an enlarged modular radiation control assembly of the desired length. Also, where two or more beams are laterally connected to form an enlarged assembly, multiple pairs of retainers preferably will be applied offset with regard to the seam between the adjacent interlocked beams to further reinforce the assembly.

4. A series of radiation control assemblies are then positioned longitudinally under, above, between or adjacent the glazing that is to be treated by the light-control assembly with the bores of the radiation-control assemblies aligned. The radiation control assemblies are mounted in place by appropriate means such as by using side beams 226 (FIG. 9A). For modular "cassette" design a mounting jam can be used.

5. Next, light-controlling members such as slats 150 or 174 of the appropriate length are slid into place in the laterally aligned bores of the bearing members so that they are supported within the successive light-controlling assemblies. In the case of slats 150 and bearing members 30, the slats will be slid into diametrically opposed notches 36*a* and 36*b* so that the opposite top and bottom edges 168 and 170 of the slats rest in opposed notch bottoms 38*a* and 38*b*. The longitudinal rigidity of the slats ensures that they can be slid into place in the successive bearing members without buckling. The torsional rigidity of the slats ensures that the slats can be rotated from one end with twisting out of shape. Finally, the deflection rigidity ensures that, one in position, the slats will not sag. Furthermore, it is noted that the overall assembly is thus readily assembled on-site and that can be used in both new construction and retrofit applications. It also ably accommodates thermal expansion and contraction of the components of the assembly, including the light-controlling members, when the assembly is subjected to wide-ranging temperature changes at the site of installation. The slats can move longitudinally within the bearing members free from the limitations imposed by rings and notches as they lengthen or shorten due to temperature swings.

6. Then, the slats are aligned and appropriate drive means attached to the control ends of the slats. "Aligned" in this context means that the slats will be parallel to each other when in the fully opened position and co-planer when in the fully closed position.

7. The resulting light-control assembly is now ready to provide light-blocking from almost full transparency to total black-out or near total black-out at a level of reliability which has heretobefore not been possible.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A light-control assembly comprising:

a beam having first and second opposed faces and at least two adjacent circular bores extending through the beams between the opposed faces, the adjacent circular bores being separated by web portions;

at least two offset bearing members with at least two diametrically opposed notches, the bearing members each having an annular ring dimensioned to fit within the bores and a flange extending radially outwardly from the rings in which the notches in the bearing members extend into the ring but not into the flanges, such that a first bearing member is mounted in a first bore with its flange adjacent to a first beam face and its ring extending into the bore and a next bearing member is mounted in a next adjacent bore with its flange adjacent the opposite beam face and its ring extending into the bore; and light-controlling members in the form of slats mounted in the bearing members with the opposed lateral edges of the slats located in the bearing member notches.

2. The light-control assembly of claim 1 including a plurality of beams with proximal and distal ends and connecting means for laterally interlocking the beams at the proximal and distal ends.

3. The light-control assembly of claim 1 including retainers mounted to the opposed faces of the beam to retain the bearing members in the assembly.

4. The light-control assembly of claim 1 in which the slats include top and bottom walls and an airspace therebetween, and ribs are formed in the airspace and extend between the top and bottom walls.

5. The light-control assembly of claim 1 in which the slats include triangular top and bottom segments providing opposite beveled faces for directing incoming light past the slats.

6. The light-control assembly of claim 1 in which the slats are provided with deformable lateral edges which extend across the web portions between adjacent bores.

7. The light-control assembly of claim 1 in which guide retention tabs are provided on opposite edges of the bearing member notches, the tabs projecting from the inner surface of the ring to define a "V" shaped cavity for receiving the slats.

8. The light-control assembly of claim 1 in which transparent or translucent sheets are positioned over, under or on both opposite sides of the slats mounted in the bearing members beam.

9. The light-control assembly of claim 1 in which the light-controlling members are in the form of clear tubular hemispherical portions and generally flat opaque or translucent barrier components and the opaque or translucent barrier components include ledges that extend beyond the outer surface of the tubular hemispherical portions and are located in the bearing member notches.

10. A light-control assembly comprising:

a beam having first and second opposed faces and at least two adjacent circular bores extending through the beams between the opposed faces, the adjacent circular bores being separated by web portions;

at least two offset bearing members with at least two diametrically opposed notches, the bearing members each having an annular ring dimensioned to fit within the bores and a flange extending radially outwardly from the rings, in which the notches in the bearing members extend through the rings and into the bearing member flanges leaving web portions of the flanges below the bottom of each of the notches, such that a first bearing member is mounted in a first bore with its flange adjacent to a first beam face and its ring extending into the bore and a next bearing member is mounted in a next adjacent bore with its flange adjacent the opposite beam face and its ring extending into the bore; and light-controlling members in the form of slats mounted in the bearing members with the opposed lateral edges of the slats located in the bearing member notches.

11. The light-control assembly of claim 10 in which guide retention tabs are provided on opposite edges of the bearing member notches, the tabs projecting from the inner surface of the ring to define a "V" shaped cavity for receiving the slats.

12. The light-control assembly of claim 10 in which transparent or translucent sheets are positioned over, under or on opposite sides of the slats mounted in the bearing members beam.

13. The light-control assembly of claim 10 in which the light-controlling members are in the form of clear tubular hemispherical portions and generally flat opaque or translucent barrier components and the opaque or translucent barrier components include ledges that extend beyond the outer surface of the tubular hemispherical portions and are located in the bearing member notches.

14. The light-control assembly of claim 10 including a plurality of beams with proximal and distal ends and connecting means for laterally interlocking the beams at the proximal and distal ends.

15. The light-control assembly of claim 10 including retainers mounted to the opposed faces of the beam to retain the bearing members in the assembly.

16. The light-control assembly of claim 10 in which the slats include top and bottom walls and an airspace therebetween, and ribs are formed in the airspace and extend between the top and bottom walls.

17. The light-control assembly of claim 10 in which the slats include triangular top and bottom segments providing opposite beveled faces for directing incoming light past the slats.

18. The light-control assembly of claim 10 in which the slats are provided with deformable lateral edges which extend across the web portions between adjacent bores.

19. A light-control assembly comprising:

a beam having first and second opposed faces and at least two adjacent circular bores extending through the beams between the opposed faces, the adjacent circular bores being separated by web portions, at least two offset bearing members with at least two diametrically opposed notches, the bearing members each having an annular ring dimensioned to fit within the bores and a flange extending radially outwardly from the rings and the notches in the bearing members extending into the ring but not into the flanges or extending through the rings and into the bearing member flanges, such that a first bearing member is mounted in a first bore with its flange adjacent to a first beam face and its ring extending into the bore and a next bearing member is mounted in a next adjacent bore with its flange adjacent the opposite beam face and its ring extending into the bore;

light-controlling members in the form of slats mounted in the bearing members with the opposed lateral edges of the slats located in the bearing member notches; and transparent or translucent sheets positioned over, under or on both opposite sides of the slats mounted in the bearing members beam.

20. The light-control assembly of claim 19 in which the slats are opaque, translucent, reflective or spectral controlling.

* * * * *